US006847932B1

(12) United States Patent
Ashimura et al.

(10) Patent No.: US 6,847,932 B1
(45) Date of Patent: Jan. 25, 2005

(54) SPEECH SYNTHESIS DEVICE HANDLING PHONEME UNITS OF EXTENDED CV

(75) Inventors: Kazuyuki Ashimura, Minoh (JP); Seiichi Tenpaku, Minoh (JP)

(73) Assignee: Arcadia, Inc., Osaka (JP)

( * ) Notice: Subject to any disclaimer, the term of this patent is extended or adjusted under 35 U.S.C. 154(b) by 802 days.

(21) Appl. No.: 09/671,683

(22) Filed: Sep. 28, 2000

(30) Foreign Application Priority Data

Sep. 30, 1999 (JP) ..... 11-280528

(51) Int. Cl.[7] ..... G10L 13/02
(52) U.S. Cl. ..... 704/266; 704/267
(58) Field of Search ..... 704/266, 254, 704/260, 258, 267

(56) References Cited

U.S. PATENT DOCUMENTS 4,862,504 A * 8/1989 Nomura ..... 704/260
5,153,913 A * 10/1992 Kandefer et al. ..... 704/260
5,384,893 A * 1/1995 Hutchins ..... 704/267
5,463,713 A * 10/1995 Hasegawa ..... 704/260
5,715,368 A * 2/1998 Saito et al. ..... 704/268
5,950,152 A * 9/1999 Arai et al. ..... 704/207
6,035,272 A * 3/2000 Nishimura et al. ..... 704/258
6,317,713 B1 11/2001 Tenpaku ..... 704/261

FOREIGN PATENT DOCUMENTS

EP 0 821 344 A2 * 1/1998 ..... 704/258
JP 64-44498 2/1989
JP 1-209500 8/1989
JP 9-185393 7/1997

* cited by examiner

*Primary Examiner*—Richemond Dorvil
*Assistant Examiner*—Donald L. Storm
(74) *Attorney, Agent, or Firm*—Michael D. Bednarek; Shaw Pittman LLP

(57) ABSTRACT

Given phonetic information is divided into speech units of extended CV which is a contiguous sequence of phonemes without clear distinction containing a vowel or some vowels. Contour of vocal tract transmission function of phoneme of the speech unit of extended CV is obtained from the phoneme directory which contains a contour of vocal tract transmission function of each phoneme associated with phonetic information in a unit of extended CV. Speech waveform data is generated based on the contour of vocal tract transmission function of phoneme of the speech unit of extended CV. Speech waveform data is converted into analog voice signal.

20 Claims, 21 Drawing Sheets

SPEECH CORPUS CONSTRUCTING PROGRAM ra i u chu : i ho : ga

FIG.6

| SYLLABLE WEIGHT | TYPE OF SYLLABLE WEIGHT | SYLLABLE CONSTRUCTURE | EXAMPLE |
|---|---|---|---|
| 1 | LIGHT SYLLABLE | (C) (y) V | ka, sa, ta, na, ha, ma, ya, ra,...<br>a, i, u, e, o, ....<br>che, pya,.... |
| 2 | HEAVY SYLLABLE | (C) (y) V R<br>(C) (y) V J<br>(C) (y) V N<br>(C) (y) V Q | to: , ya:, kyu:, pyu:,...<br>kai, nou, ai, ui, pyua,...<br>kaN, aN, myaN, chaN,...<br>chuQ, ryaQ, jaQ, hyaQ,... |
| 3 OR MORE | SUPER HEAVY SYLLABLE | (C) (y) V R N<br>(C) (y) V R Q<br>(C) (y) V J N<br>(C) (y) V J Q<br>(C) (y) V N Q<br>AND THE LIKE | che:N, ju:N, a:N, ...<br>u:Q, che:Q,...<br>saiN, pauN, auN, chaiN,...<br>kaiQ, daiQ, kyaiQ, uiQ,...<br>doNQ, uNQ, chaNQ,... |

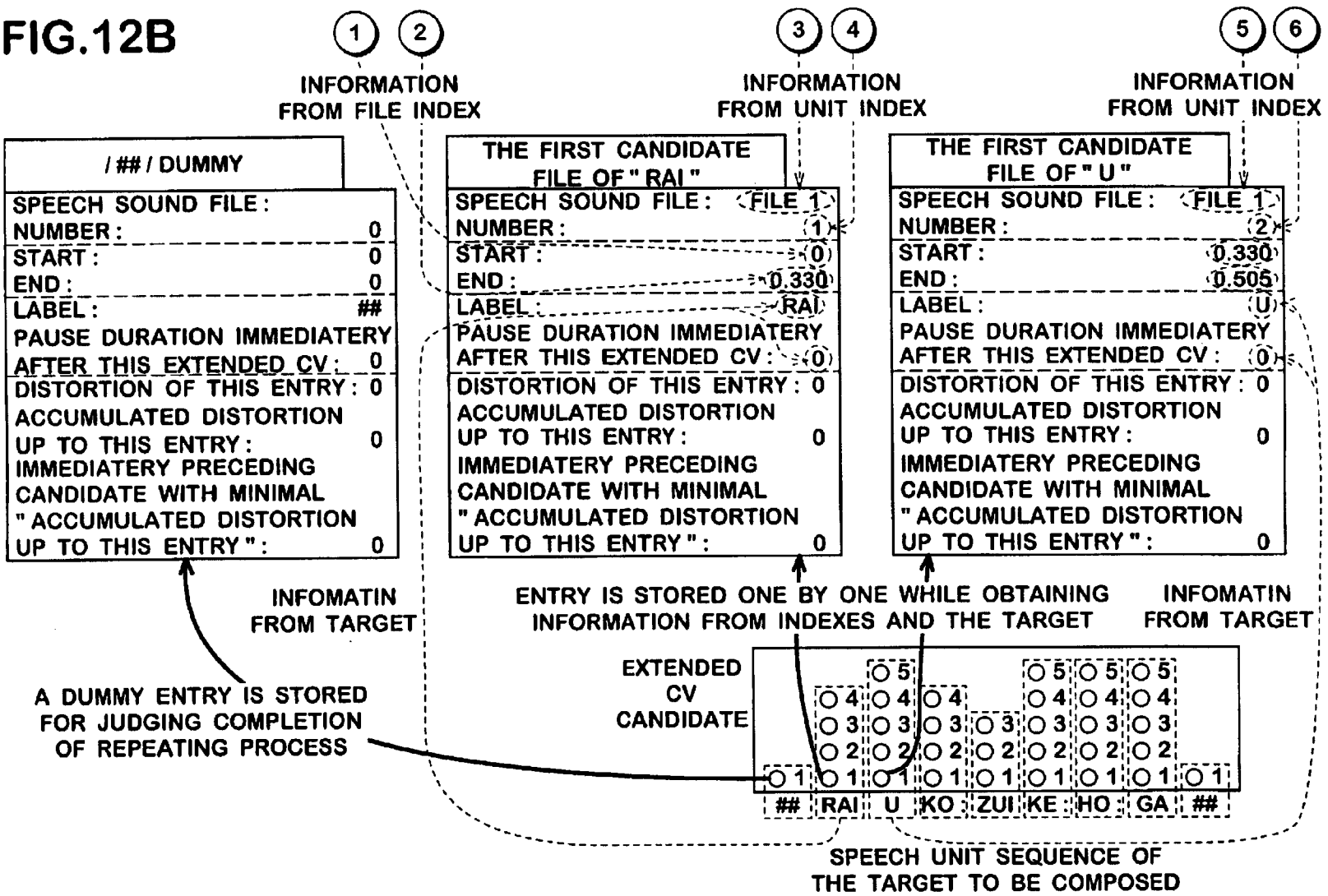
FIG.12B
/ ## / DUMMY
SPEECH SOUND FILE:
NUMBER: 0
START: 0
END: 0
LABEL: ##
PAUSE DURATION IMMEDIATERY AFTER THIS EXTENDED CV: 0
DISTORTION OF THIS ENTRY: 0
ACCUMULATED DISTORTION UP TO THIS ENTRY: 0
IMMEDIATERY PRECEDING CANDIDATE WITH MINIMAL "ACCUMULATED DISTORTION UP TO THIS ENTRY": 0
INFORMATION FROM FILE INDEX
1
2
THE FIRST CANDIDATE FILE OF "RAI"
SPEECH SOUND FILE: FILE 1
NUMBER: 1
START: 0
END: 0.330
LABEL: RAI
PAUSE DURATION IMMEDIATERY AFTER THIS EXTENDED CV: 0
DISTORTION OF THIS ENTRY: 0
ACCUMULATED DISTORTION UP TO THIS ENTRY: 0
IMMEDIATERY PRECEDING CANDIDATE WITH MINIMAL "ACCUMULATED DISTORTION UP TO THIS ENTRY": 0
INFORMATION FROM UNIT INDEX
3
4
THE FIRST CANDIDATE FILE OF "U"
SPEECH SOUND FILE: FILE 1
NUMBER: 2
START: 0.330
END: 0.505
LABEL: U
PAUSE DURATION IMMEDIATERY AFTER THIS EXTENDED CV: 0
DISTORTION OF THIS ENTRY: 0
ACCUMULATED DISTORTION UP TO THIS ENTRY: 0
IMMEDIATERY PRECEDING CANDIDATE WITH MINIMAL "ACCUMULATED DISTORTION UP TO THIS ENTRY": 0
INFORMATION FROM UNIT INDEX
5
6
INFOMATIN FROM TARGET
ENTRY IS STORED ONE BY ONE WHILE OBTAINING INFORMATION FROM INDEXES AND THE TARGET
INFOMATIN FROM TARGET
EXTENDED CV CANDIDATE
1 1 1 1 1 1 1 1
RAI U KO ZUI KE HO GA ##
2 3 4 5
2 3 4 5
2 3 4 5
2 3 4 5
A DUMMY ENTRY IS STORED FOR JUDGING COMPLETION OF REPEATING PROCESS
SPEECH UNIT SEQUENCE OF THE TARGET TO BE COMPOSED SPEECH UNIT SEQUENCE OF THE TARGET TO BE COMPOSED
( ● IS THE OPTIMAL SPEECH UNIT )
( → IS THE OPTIMAL SEQUENCE OF SPEECH UNIT CANDIDATES )

FIG.18

DICTIONARY OF EXTENDED CV DURATION

| EXTENDED CV | DURATION : [ MS ] |
|---|---|
| CHU : | 391 |
| KO : | 213 |
| ⋮ | ⋮ |
| ⋮ | ⋮ |

FIG.19
PHONEME DICTIONARY
| EXTENDED CV | TIME | VOCAL TRACT TRANSMISSION CHARACTERISTIC |
|---|---|---|
| CHU : | 0 ~ 2 ms | 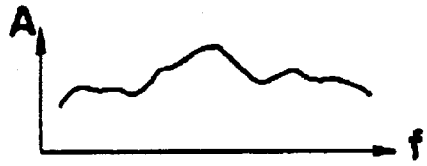  |
| | ⋮ | ⋮ |
| | 383 ~ 391 ms | 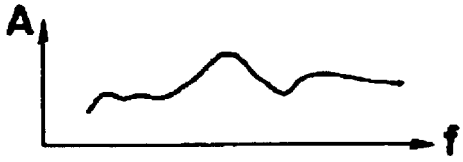  |
| ⋮ | ⋮ | ⋮ |
| ZUI | 0 ~ 3 ms | 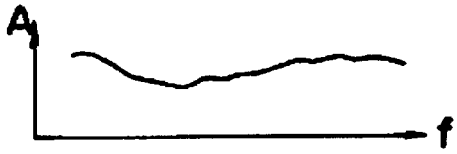  |
| | ⋮ | ⋮ |
| | 201 ~ 223 ms | 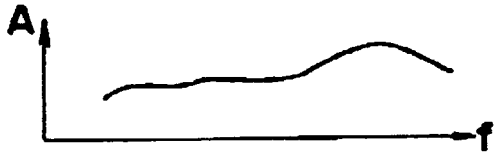  |
| ⋮ | ⋮ | ⋮ |

SPEECH SYNTHESIS DEVICE HANDLING PHONEME UNITS OF EXTENDED CV

CROSS REFERENCE TO RELATED APPLICATIONS

All the content disclosed in Japanese Patent Application No. H11-280528 (filed on Sep. 30, 1999), including specification, claims, drawings and abstract and summary, is incorporated herein by reference in its entirety.

BACKGROUND OF THE INVENTION

1. Field of the Invention

This invention relates to speech synthesis and speech analysis, and, more particularly, to improvements in speed and quality thereof.

2. Description of the Related Art

Two popular methods of speech synthesis are speech synthesis by rule and concatenative synthesis using a speech corpus.

In speech synthesis by rule, a given phoneme symbol string is divided into speech units such as phonemes (which correspond to roman letters such as "a" or "k"). Then, the contour of fundamental frequency and a vocal tract transmission function are determined according to rules for each speech unit. Finally, the generated waveforms in a speech unit are concatenated to synthesize speech.

However, continuity distortion results often in the concatenation procedure. To eliminate this continuity distortion, the rules of converting waveform in concatenation procedure can be prepared according to each kind of speech unit. However, this solution requires complex rules and time-consuming procedures.

In concatenative synthesis using a speech corpus, speech waveforms to be composed are obtained by means of extracting sample speech waveform data from the prepared speech corpus and concatenating them. The speech database (speech corpus) stores a large number of speech waveforms of natural speech utterances and their corresponding phonetic information.

Some of the reference books about concatenative synthesis using a speech corpus are Yoshinori Sagisaka: "Speech Synthesis of Japanese Using Non-Uniform Phoneme Sequence Units" Technical Report SP87-136, IEICE, W. N. Campbell and A. W. Black: "Chatr: a multi-lingual speech re-sequencing synthesis system" Technical Report SP96-7, IEICE, and Yoshinori Sagisaka: "Corpus Based Speech Synthesis" Journal of Signal Processing.

With these conventional technologies, in concatenative synthesis using a speech corpus waveforms associated with a given phoneme symbol string are obtained as follows. First, a given phoneme symbol string is divided into phonemes. Next, a sample speech waveform is extracted according to the longest phoneme string-matching method. Then, a speech waveform is obtained from concatenation of extracted pieces of sample speech waveforms.

However, since the speech corpus is searched by a unit of phoneme, the searching procedure requires a massive amount of time. In addition, regardless of how much time is spent in searching, the synthesized speech often comes out unnatural although the longest matching phoneme string can be extracted.

SUMMARY OF THE INVENTION

It is an object of the present invention to provide a speech synthesis device and speech sound processing method capable of solving these problems described above and improving both processing time and quality of synthesized speech.

In accordance with characteristics of the present invention, there is provided a speech synthesis device comprising:

speech database storing means for storing speech database created by dividing the sample speech waveform data obtained from recording human speech utterances into speech units, and associating the sample waveform data in each speech unit with their corresponding phonetic information;

speech waveform composing means for dividing phonetic information into speech units upon receiving the phonetic information of speech sound to be synthesized, for obtaining sample speech waveform data from the speech database corresponding to the each phonetic information in a speech unit, and for generating speech waveform data to be composed by means of concatenating the sample speech waveform data in a speech unit; and analog converting means for converting a speech waveform data received from the speech waveform composing means into analog signals;

wherein the speech database storing means divides the sample speech waveform data into the speech units of Extended CV, which is a contiguous sequence of phonemes without clear distinction containing a vowel or some vowels;

and wherein the speech waveform composing means divides the phonetic information into speech units of Extended CV.

Also, in accordance with characteristics of the present invention, there is provided a computer-readable storing medium for storing a program for executing speech synthesis by means of a computer using a speech database constructed with sample speech waveform data associated with its corresponding phonetic information, the program comprising the steps of:

dividing phonetic information into Extended CVs upon receiving the phonetic information of speech sound to be synthesized;

obtaining sample speech waveform data corresponding to the divided phonetic information in Extended CV from the speech database; and generating speech waveform data to be composed by means of concatenating the sample speech waveform data in Extended CV;

wherein the Extended CV refers to a contiguous sequence of phonemes without clear distinction containing at least one vowel.

Further, in accordance with characteristics of the present invention, there is provided a speech synthesis device comprising:

dividing means for dividing the phonetic information into Extended CVs upon receiving the phonetic information of speech sound to be synthesized;

speech waveform composing means for generating speech waveform data in a unit of Extended CV divided with the dividing means, and for obtaining speech waveform data to be composed by means of concatenating the speech waveform data in a unit of each Extended CV; and analog converting means for converting the speech waveform data provided from the speech waveform composing means into analog signals of speech sound;

wherein the Extended CV refers to a contiguous sequence of phonemes without clear distinction containing at least one vowel.

In accordance with characteristics of the present invention, there is provided a computer-readable storing medium for storing a program for executing speech synthesis using a computer, the program comprising the steps of:

dividing phonetic information into Extended CVs upon receiving the phonetic information of speech sound to be synthesized;

generating speech waveform data in a unit of Extended CV; and obtaining speech waveform data to be composed by means of concatenating the speech waveform data in a unit of each Extended CV;

wherein the Extended CV refers to a contiguous sequence of phonemes without clear distinction containing at least one vowel.

Also, in accordance with characteristics of the present invention, there is provided a computer-readable storing medium for storing a program for executing dividing process using a computer, the program comprising the step of:

dividing phonetic information into Extended CVs upon receiving the phonetic information;

wherein the Extended CV refers to a contiguous sequence of phonemes without clear distinction containing at least one vowel.

Further, in accordance with characteristics of the present invention, there is provided a computer-readable storing medium for storing a speech database, the database comprising:

a waveform data area storing sample speech waveform data divided into Extended CV; and a phonetic information area that stores the phonetic information associated with sample speech waveform data in a unit of each Extended CV;

wherein the Extended CV refers to a contiguous sequence of phonemes without clear distinction containing at least one vowel.

In accordance with characteristics of the present invention, there is provided a computer-readable storing medium for storing phonetic information data to be used for speech processing;

wherein the phonetic information data is characterized by being handled in a unit of Extended CV provided with division information per Extended CV;

and wherein the Extended CV refers to a contiguous sequence of phonemes without clear distinction containing at least one vowel.

Also, in accordance with characteristics of the present invention, there is provided a computer-readable storing medium for storing a phoneme dictionary to be used for speech processing, wherein the phoneme dictionary contains the contour of vocal tract transmission function of each phoneme associated with phonetic information in a unit of Extended CV;

and wherein the Extended CV refers to a contiguous sequence of phonemes without clear distinction containing at least one vowel.

Further, in accordance with characteristics of the present invention, there is provided a speech processing method comprising the step of:

treating a contiguous sequence of phonemes without clear distinction containing at least one vowel as Extended CV that is a unit which can not be split any more.

In the present invention, the term "speech unit" refers to a unit in which speech waveforms are handled, in speech synthesis or speech analysis.

The term "speech database" refers to a database in which at least speech waveforms and their corresponding phonetic information are stored. In an embodiment of the present invention, a speech corpus is corresponding to a speech data base.

The term "speech waveform composing means" refers to means for generating a speech waveform corresponding to a given phonetic information according to rules or sample waveforms. In an embodiment of the present invention, steps S12 to S19 in FIG. 10 and steps S102 to S106 in FIG. 17 correspond to this.

The term "storing medium on which programs or data are stored" refers to a storing medium including, for example, a ROM, a RAM, a flexible disk, a CD-ROM, a memory card or a hard disk on which programs or data are stored. It also includes a communication medium like a telephone line and a transfer network. In other words, this includes not only the storing medium like a hard disk which stores programs executable directly upon connection with CPU, but also the storing medium like a CD-ROM etc. which stores programs executable after being installed in a hard disk. Further, the term "programs (or data)" herein, includes not only directly executable programs, but also source programs, compressed programs (or data) and encrypted programs (or data).

Other objects and features of the present invention will be more apparent to those skilled in the art on consideration of the accompanying drawings and following specification wherein are disclosed several exemplary embodiments of the invention. It should be understood that variations, modifications and elimination of parts may be made therein as fall within the scope of the appended claims without departing from the spirit of the invention.

BRIEF DESCRIPTION OF THE DRAWINGS

FIG. 6 is a view showing a definition of Extended CV showing the relationships between syllable weight and syllable structure, and examples of Extended CV;

FIG. 12B is a view illustrating a mechanism of making up entries;

FIG. 18 shows the contents of a dictionary of syllable duration;

FIG. 19 shows the contents of a phoneme dictionary.

DETAILED DESCRIPTION OF THE PREFERRED EMBODIMENTS

1. THE FIRST REPRESENTATIVE EMBODIMENT (1) Overall Structure

Figure 1:
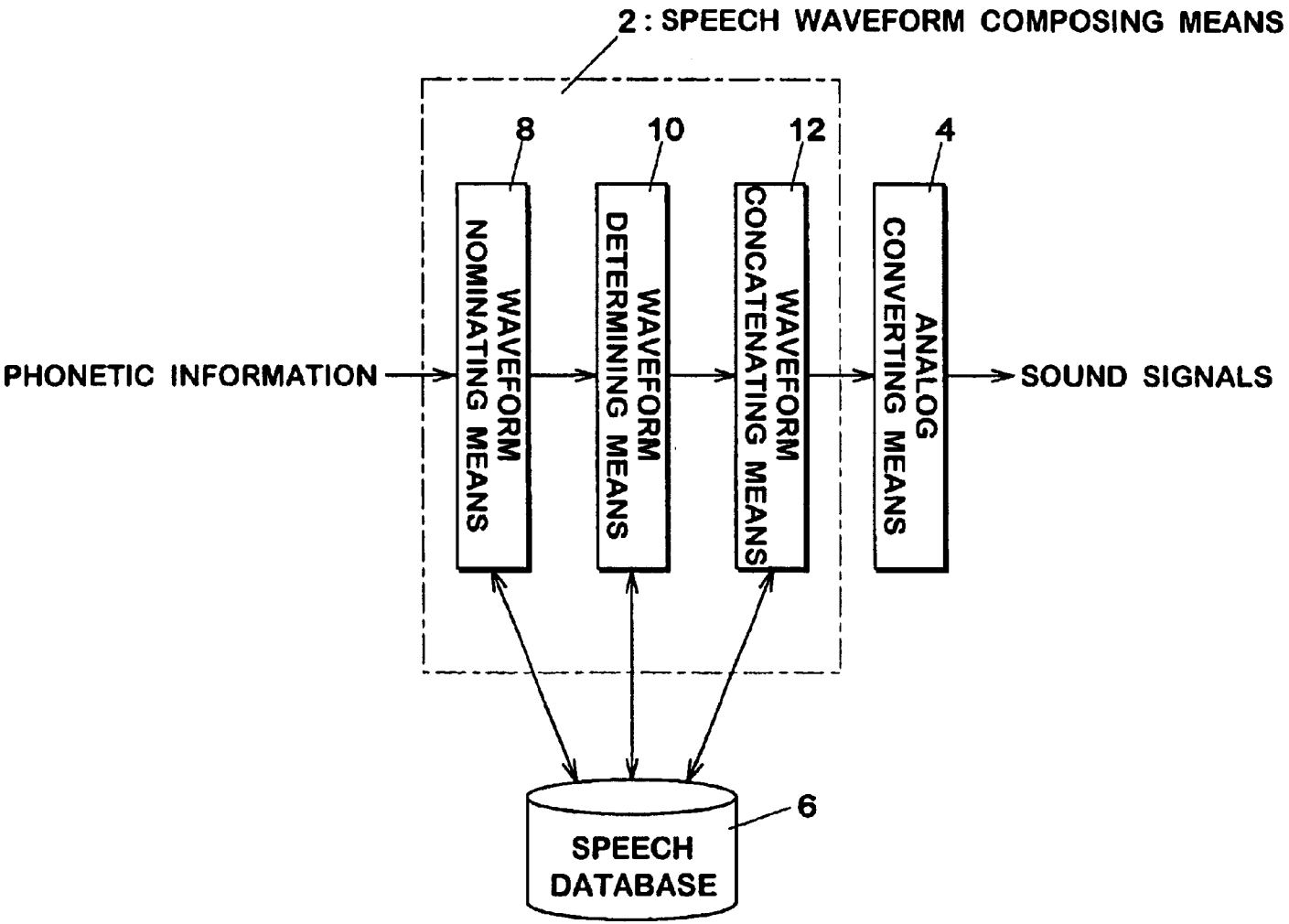
FIG. 1 is a diagram illustrating an overall configuration of the speech synthesis device according to a representative embodiment of the present invention.

FIG. 1 shows an overall structure of the speech synthesis device according to a representative embodiment of the present invention. This device includes speech waveform composing means 2, analog converting means 4 and a speech database 6. The speech waveform composing means 2 includes waveform nominating means 8, waveform determining means 10 and waveform concatenating means 12. The speech database 6 is constructed of a large number of sample speech waveform data obtained by means of recording natural speech utterances, which are divided into Extended CVs and are capable of being searched in accordance with phonetic information.

The phonetic information of speech sound to be synthesized is provided to the waveform nominating means 8. The waveform nominating means 8 divides the provided phonetic information into Extended CVs and obtains their corresponding sample speech waveform data from the speech database 6. Since a large volume of sample waveform data is stored in the speech database 6, several candidates of speech waveform data per Extended CV are nominated.

The waveform determining means 10, by referring to the continuity with the preceding or succeeding phonemes or syllables, selects one sample speech waveform data per Extended CV out of several candidates of sample speech waveform data nominated by the waveform nominating means 8.

Then, the waveform concatenating means 12 concatenates a series of sample speech waveform data determined by the waveform determining means 10, and obtains the speech waveform data to be composed.

Moreover, the analog converting means 4 converts this speech waveform data into analog signals and produces output. Thus, the sound signals corresponding to the phonetic information can be obtained.

(2) Hardware Configuration

Figure 2:
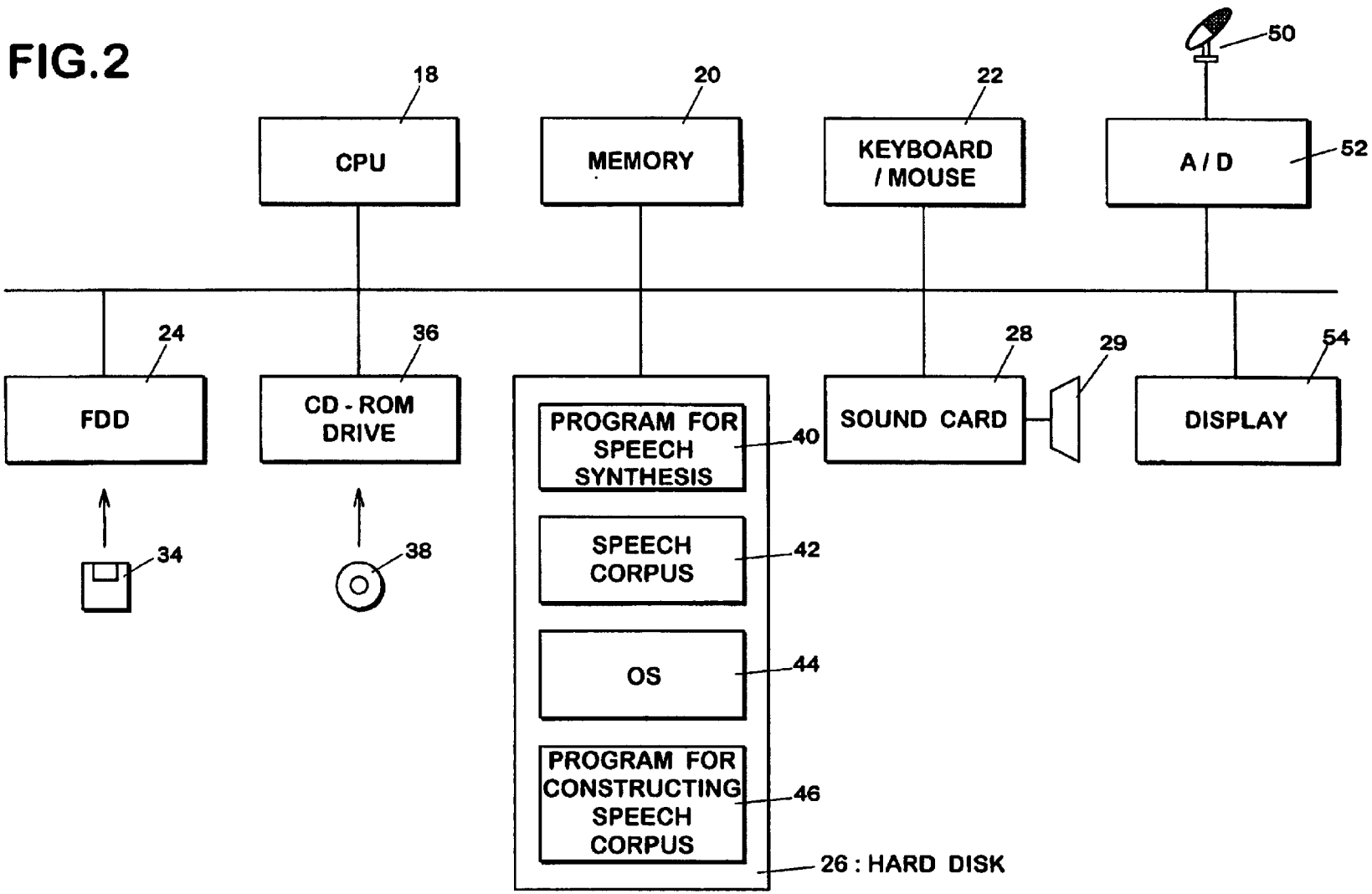
FIG. 2 is a block diagram showing a hardware configuration of the speech synthesis device according to a representative embodiment of the present invention.

FIG. 2 shows representative embodiment of one of a hardware configuration using a CPU for the device of FIG. 1. Connected to a CPU 18 are a memory 20, a keyboard/mouse 22, a floppy disk drive (FDD) 24, a CD-ROM drive 36, a hard disk 26, a sound card 28, an A/D converter 62 and a display 54. Stored in the hard disk 26 are an operating system (OS) 44 such as WINDOWS 98™ by Microsoft™, a speech synthesis program 40, and a speech corpus constructing program 46 for constructing a speech corpus as a speech database. Furthermore, the hard disk 26 also stores a speech corpus 42 constructed by the speech corpus constructing program 46. These programs are installed from the CD-ROM 38 using the CD-ROM drive 36.

In this representative embodiment, the speech synthesis program 40 performs its functions in combination with the operating system (OS) 44. However, the speech synthesis program 40 may perform a part of or all of its functions by itself.

(3) Speech Corpus Construction

In the speech synthesis device of this first embodiment, it is necessary to prepare the speech corpus 42 before speech synthesis procedure. The speech corpus 42 is constructed in advance may be installed to the hard disk 26. Alternatively, the speech corpus 42 that is stored in other computers connected through network (such as LAN or the Internet) may be used.

Figure 3:
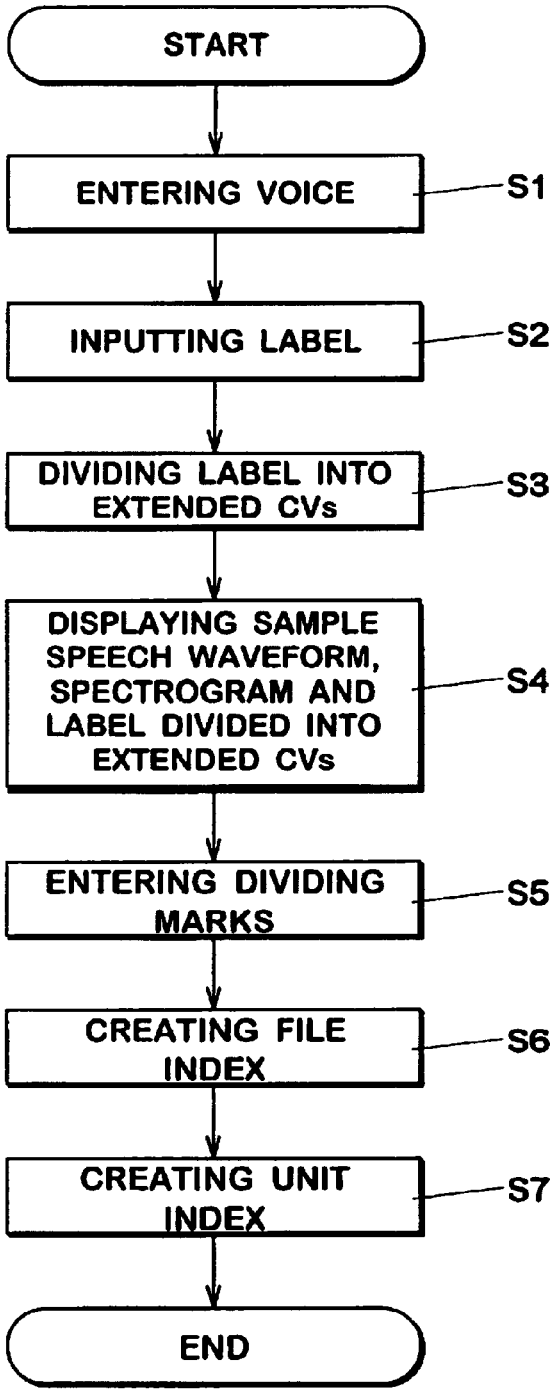
FIG. 3 is a flow chart showing the speech corpus constructing program.

FIG. 3 is a flow chart showing the speech corpus constructing program. First, an operator enters his or her voice as a sample using a microphone 50. The CPU 18 takes in the speech sound through the microphone 50, converts same into sample speech waveform data in digital form by using the A/D converter 52, and stores it into the hard disk 26 (step S1 of FIG. 3). Next, the operator inputs a label (reading as phonetic information) corresponding to the entered speech sound, using the keyboard 22. Then, the CPU 18 stores the provided label in the hard disk 26, in association with the sample speech waveform data.

Figures 4A, 4B:
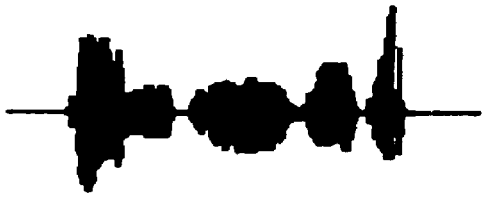
FIG. 4A shows a sample speech waveform data.
FIG. 4B shows a kana character string.

FIGS. 4A and 4B show an example of sample speech waveform data and a label stored on the hard disk 26. In this example, it is assumed that a speech utterance of "/ra i u chu: i ho: ga/" is entered.

Then, the CPU 18 divides the label of "ra i u chu: i ho: ga" into Extended CVs (step S3 in FIG. 3). Here, "Extended CV" in this representative embodiment refers to a series of sounds (a phoneme sequence) containing a vowel, which is extracted as a speech unit using the leftmost longest match method. The number of vowels in vowel catenation is limited to at most two, and three vowels catenation is split at between the second and the third vowel. Here, a "phoneme" refers to the smallest unit of speech that has a distinctive meaning in a certain language. If a speech sound distinguishes one utterance from another in the previously mentioned language, it is regarded as a phoneme.

Figure 5:
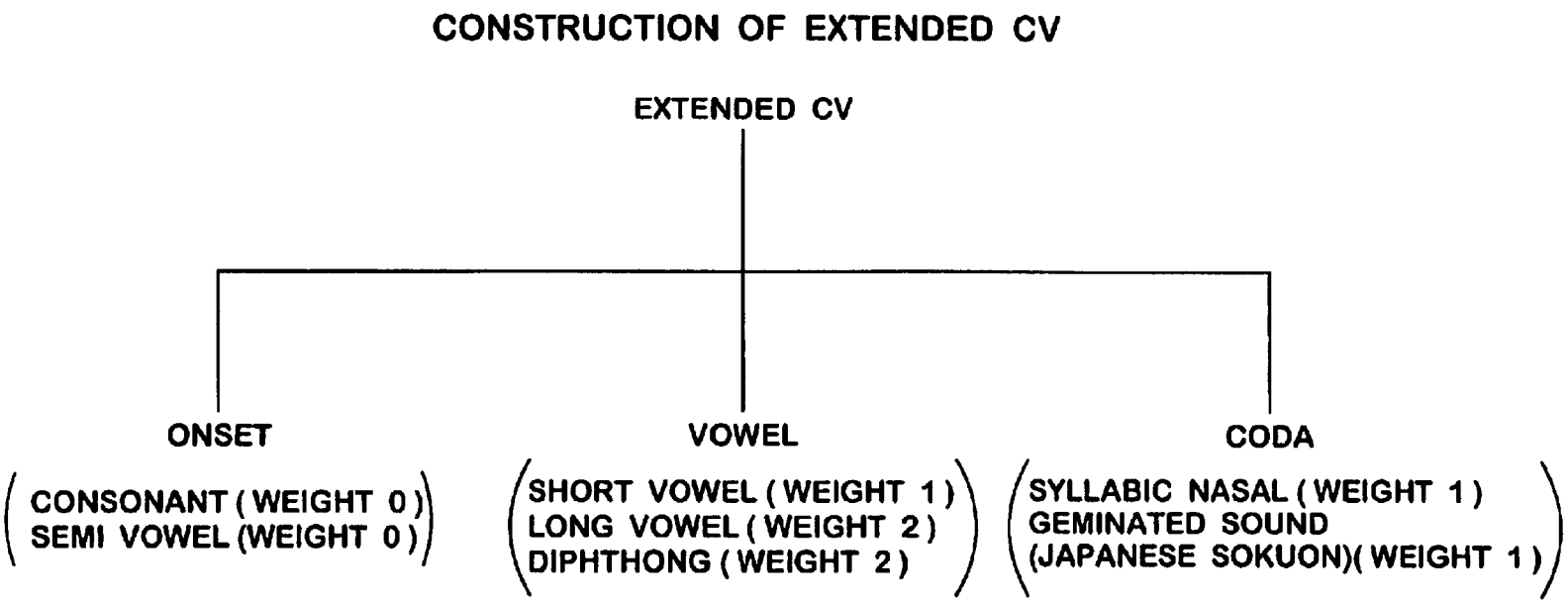
FIG. 5 is a view showing a structure of Extended CV.

FIG. 5 shows the structure of "Extended CV" in this representative embodiment. Extended CV must contain either one of a short vowel (a vowel), long vowel (a vowel+the latter part of a long vowel) or a diphthong (a vowel+the second element of a diphthong) as its core. In addition, the core vowel is attached with an onset (a consonant or a semi vowel) or some onsets (sometimes no onset is attached) and a coda (a syllabic nasal or a geminated sound (Japanese SOKUON)).

The syllable weight of "Extended CV" is determined by defining the syllable weight of a consonant "C" (excluding a geminated sound (Japanese SOKUON), a semi vowel and a syllabic nasal) and a semi vowel "y", as "0", and that of a vowel "V" (excluding the latter part of a long vowel and the second element of a diphthong), the latter part of a long vowel "R", the second element of a diphthong "J", a syllabic nasal "N" and a geminated sound "Q" as "1". This syllable weight specifies the weight of each Extended CV, according to which Extended CVs are classified into three categories.

FIG. 6 shows the table listing Extended CVs used in this representative embodiment. "Extended CV" is classified into three groups: a light syllable holding the syllable weight of "1", a heavy syllable holding the syllable weight of "2", and a superheavy syllable holding the syllable weight of "3". A light syllable like "/ka/", "/sa/", "/che/" or "/pya/" is denoted with (C)(y) V. The so-called mora is corresponding to a light syllable. In addition, (C) denotes that C or some Cs may or may not be attached to V. This meaning applies to (y), too.

A heavy syllable like "/to:/", "/ya:/", "/kai/", "/noul/", "/kaN/", "/aN/", "/cyuQ/" or "/ryaQ/" is denoted with (C)(y) VR, (C)(y)VJ, (C)(y)VN, or (C)(y)VQ.

A superheavy syllable like "/che:N/", "/u:Q/", "/saiN/", "/kaiQ/" or "/doNQ/" is denoted with (C)(y)VRN, (C)(y) VRQ, (C)(y)VJN, (C)(y)VJQ or (C)(y)VNQ.

In the step of S3 of FIG. 3, the CPU 18 divides the label of "ra i u chu: i ho: ga" into Extended CVs according to the definition of "Extended CV" (in accordance with the definition algorithm or an at-a-glance table of "Extended CV"). In this process, the longer Extended CV in the label is extracted first. Thus, six Extended CVs as "rai", "u", "chu:", "i", "ho:" and "ga" are obtained.

Figure 7:
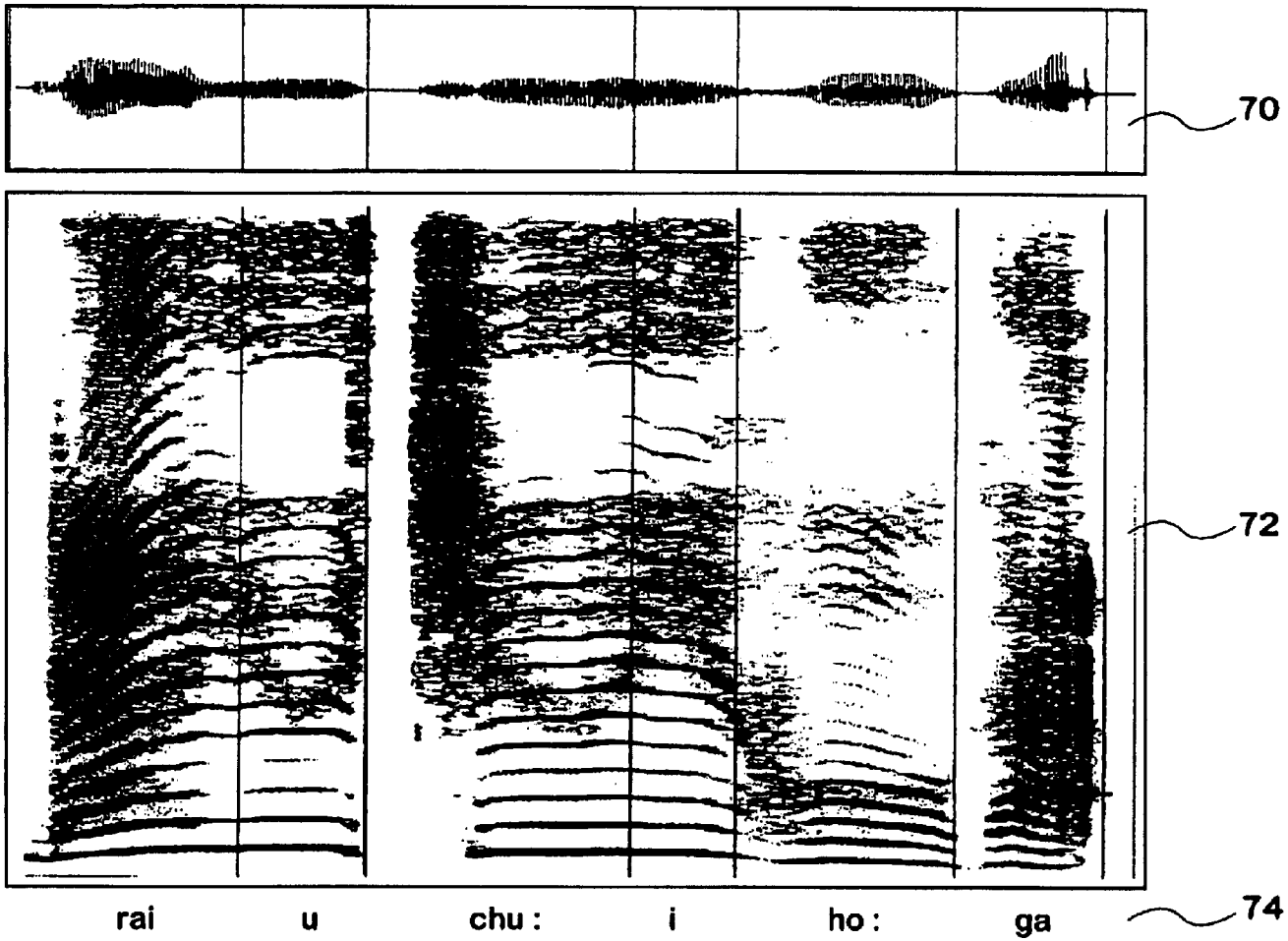
FIG. 7 is a view illustrating a sample speech waveform data, a spectrogram, and a character string divided into Extended CVs displayed on the screen.

Next, the CPU 18 shows a sample speech waveform 70, a spectrogram (contour of frequency component) 72 and labels divided into Extended CVs 74 on a display 54, as shown in FIG. 7.

Then, the operator divides the sample speech waveform 70 into Extended CVs by means of entering dividing marks using a mouse 22, with referring to the data on the screen (step S5 in FIG. 7). Thus, as shown in FIG. 8*a*, the hard disk 26 stores a speech sound file 1 or the sample speech waveform, which are divided into Extended CVs and attached with labels.

Figure 8:
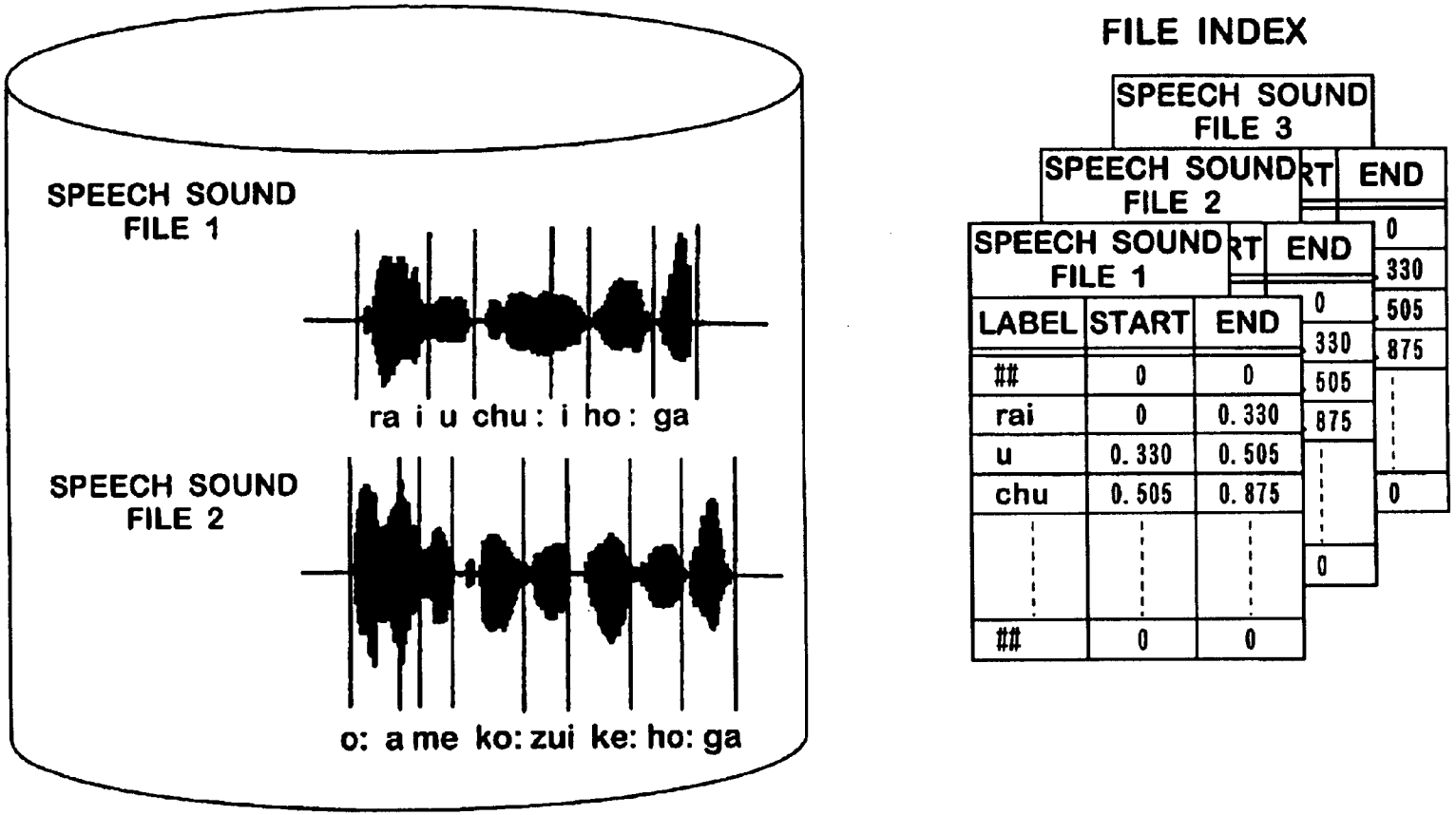
FIG. 8 shows the relationship between a speech sound file and a file index.

Next, the CPU 18 creates a file index as shown in FIG. 8 and stores it to the hard disk 26. The file index records the labels divided into Extended CVs and the starting and ending time of the sample speech waveform data corresponding to each label. The head and the tail of the file index of each speech sound file is marked with "##" to indicate the start and the end. A file index is created as many as the number of sample speech waveform data.

Figure 9:
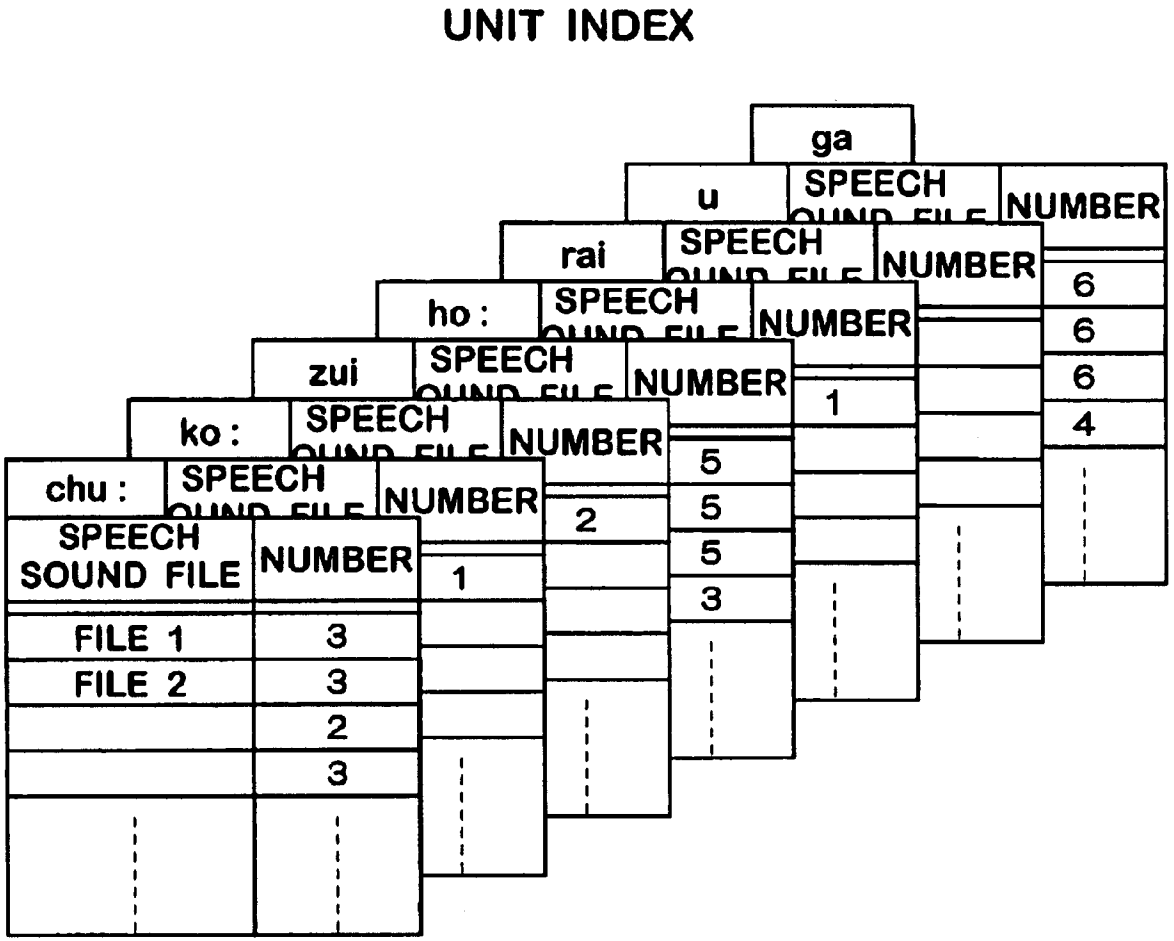
FIG. 9 is a view showing a unit index.

Furthermore, the CPU 18 creates a unit index as shown in FIG. 9 and stores it into the hard disk 26. The unit index is an index of the Extended CV listing all its corresponding sample speech waveforms. For example, under the heading such as "chu:", FIG. 9 indicates that a file name "file 1" stores the sample waveform of the Extended CV "chu:" and has a storing order indicated as "3". This unit index also indicates that another sample speech waveform of "chu:" is stored in the file "2" in storing order "3". Thus, the CPU 18 creates the unit index of Extended CV that provides the file names and the storing order of all files where the heading Extended CV is stored.

Unit indexes are stored after being sorted in order of decreasing length of the Extended CV label (number of characters when represented in kana characters, the Japanese syllabaries), in order to provide an efficient search procedure during speech synthesis. Consequently, unit indexes are sorted in order of decreasing syllable weight.

Thus, the speech sound files, the file indexes and the unit indexes are stored as the speech corpus 42 on the hard disk 26.

In the representative embodiment described as above, the dividing marks are entered on the sample speech waveform data by the operator. However, the sample speech waveform data may be divided into Extended CVs automatically in accordance with the transition of waveform data or frequency spectrum. Alternatively, the operator may confirm or correct the divisions that the CPU 18 provisionally makes.

(4) Speech Synthesis Processing

Figure 10:
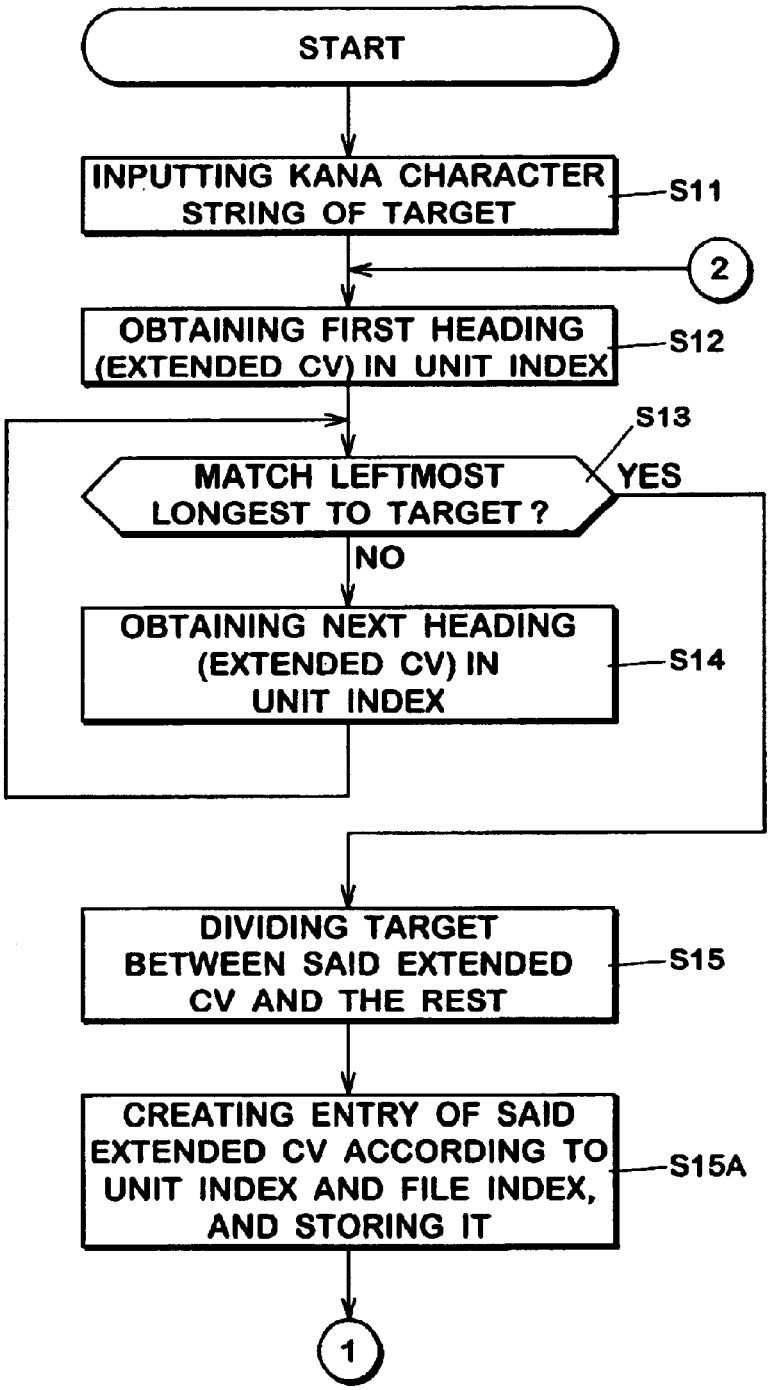
FIG. 10 is a flow chart showing the speech synthesis processing program.
Figure 11:
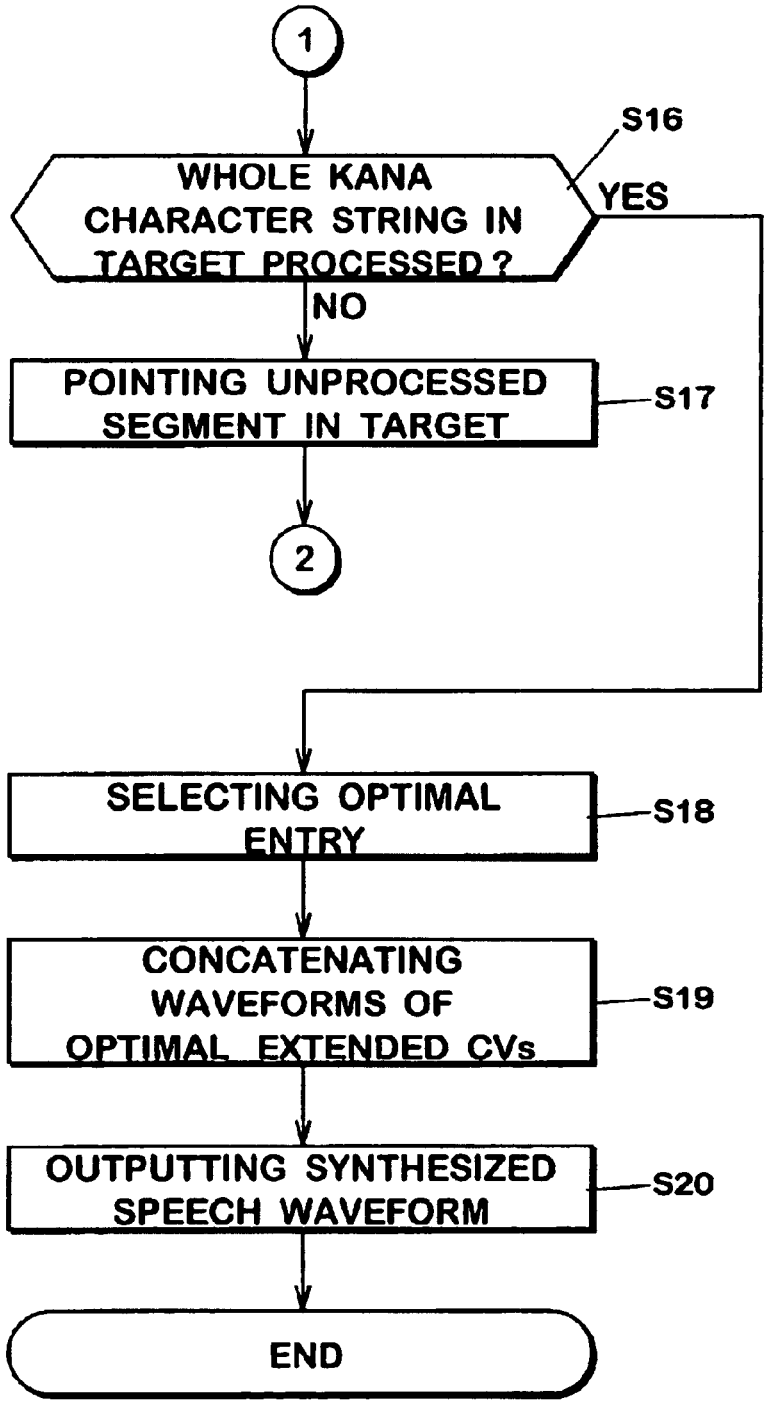
FIG. 11 is a flow chart showing the speech synthesis processing program.

FIG. 10 and FIG. 11 show the flow chart of a program for speech synthesis 40 stored in the hard disk 26. First, the operator inputs a "kana character string" corresponding to the target speech (speech sound to be synthesized) using the keyboard 22 (step S11). Here, for example, it is assumed that the target is typed in kana characters as "ra i u ko: zu i ke: ho: ga".

Alternatively, this kana character string loaded from the floppy disk 34 through the FDD 24 or may be transferred from other computers through networks. Alternatively, other phonetic information such as kanji and kana text may be converted into a "kana character string" with using a dictionary that is prestored in the hard disk 26. Further, prosodic information such as accents or pauses may be added.

First, the CPU 18 obtains the first (the longest) heading (Extended CV) from the unit indexes stored in the speech corpus 42. According to FIG. 9, "chu:" is obtained. While FIG. 9 shows only a part of the unit indexes, it should be understood that there is actually an enormous number of Extended CVs in each unit index.

Next, the CPU 18 determines whether this "chu:", the Extended CV, can be the leftmost longest match to the target of "ra i u ko: zu i ke: ho: ga" (step S13 in FIG. 10). Since "chu:" does not match to the target, the next heading in the unit indexes, "ko:", is obtained (step S14 in FIG. 10) and judged in the same way (step S13 in FIG. 10). These steps repeat until the Extended CV of "rai" that matches leftmost longest to the target Based on matching Extended CV "rai", the CPU 18 separates "rai" from "u" in the target of "ra i u ko: zu i ke: ho: ga". That is to say, "rai" is extracted as an Extended CV (step S15 in FIG. 10). Accordingly, an efficient procedure of extracting Extended CVs is available, since Extended CVs are sorted in order of decreasing length of a character string in the speech corpus 42.

Figure 12A:
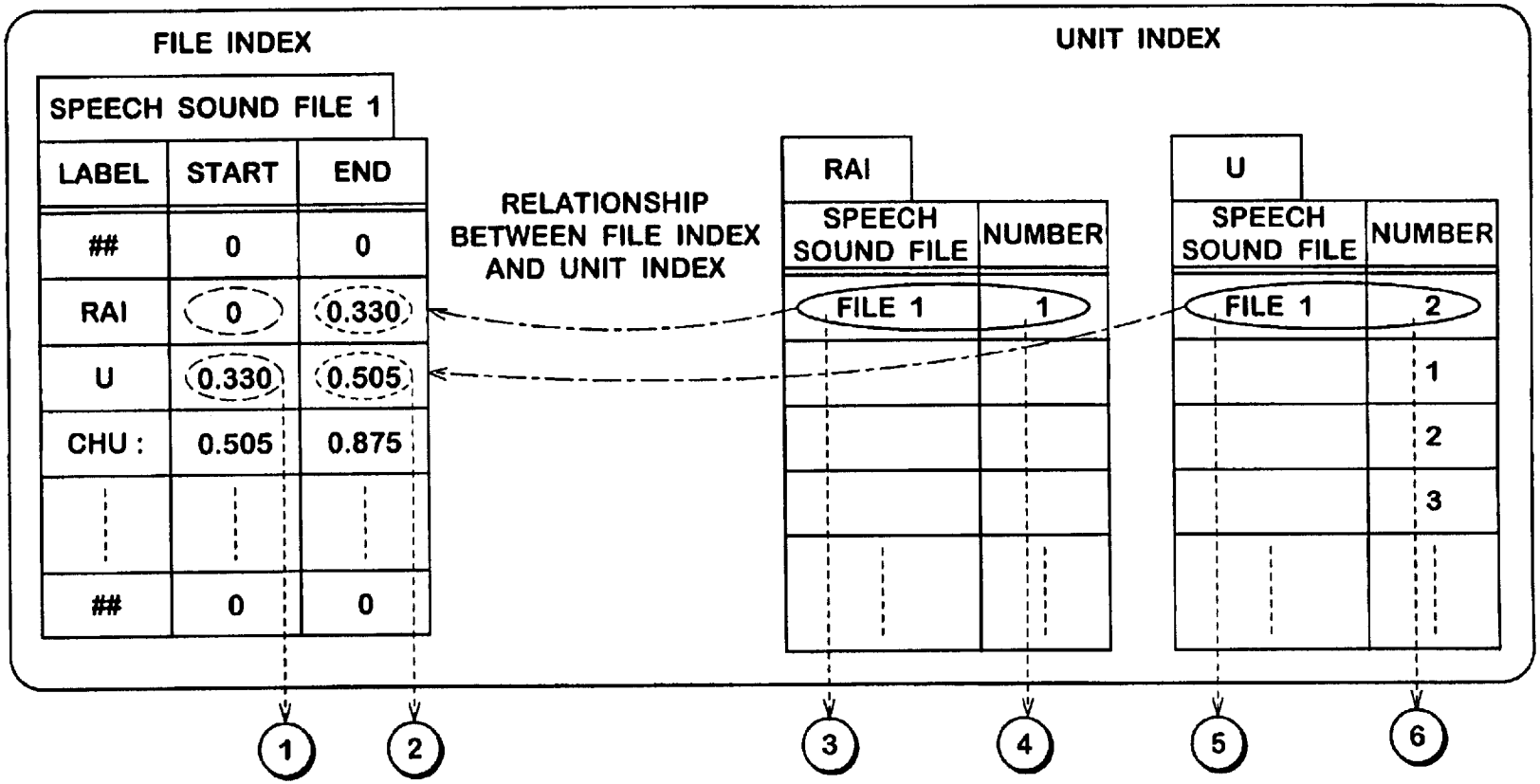
FIG. 12A is a view illustrating a mechanism of making up entries.

Next, the CPU 18 creates candidate files (entries) as shown in FIGS. 12A and 12B, referring to the file index specified in the unit index of "rai" (step S15A in FIG. 10). FIGS. 12A and 12B show the first candidate file of "rai". In this candidate file, the file name of the speech sound file, the order in the file, the starting and ending time, and the label are recorded. The candidate file (entry) is created as many as the number of sample speech waveform data of "rai" in the speech corpus 42.

Then, the CPU 18 assigns a number to all entries generated for "rai" (such as the first, the second, candidate file) and stores them associated with "rai" (see the Extended CV candidates in the speech unit sequence of a target). FIGS. 12A and 12B show that there are four entries for "rai".

After extracting Extended CV from the target described as above, the CPU 18 determines whether there is an unprocessed segment in the target. In other words, the CPU 18 judges if there is Extended CV left unextracted in the target (step S16 in FIG. 11).

If there is an Extended CV left unextracted, the steps from S12 forward (FIG. 10) are repeated for the unprocessed segment (step S17). Then, the succeeding "u" is extracted and its entries are created. Further, the extended CV candidates for "u" in the speech unit sequence are obtained. FIGS. 12A and 12B indicate that there are five entries for "u".

Thus, Extended CVs are extracted and their corresponding sample speech waveform data is specified (obtained). FIGS. 12A and 12B show all the Extended CV candidates in the completed speech unit sequence. In this embodiment, "##" is used for indicating the beginning and the end of the speech unit sequence.

Then, the CPU 18 selects the optimal entry from among the Extended CV candidates (step S18 in FIG. 11). In this representative embodiment, the optimal entry is selected according to "environment distortion" and "continuity distortion" defined as follows.

"Environment distortion" is defined as the sum of "target distortion" and "contextual distortion".

"Target distortion" is defined, on the precondition that the target Extended CV matches up with its corresponding Extended CV in the speech corpus, as the distance of the immediately preceding and succeeding phoneme environment between the target and the speech corpus. Target distortion is further defined as the sum of "leftward target distortion" and "rightward target distortion".

"Leftward target distortion" is defined to be "0" when the immediately preceding Extended CV in the target is the same as that in the sample, and defined to be "1" when they are different. However, in case that the immediately preceding phoneme in the target is same as that in the sample, leftward target distortion is defined to be "0" even if the both preceding Extended CVs do not match up with each other. Furthermore, when the immediately previous phoneme in the target and in the sample is a silence or a geminated sound (Japanese SOKUON), leftward target distortion is defined as "0" considering that previous phonemes are conforming to each other.

"Rightward target distortion" is defined to be "0" when the immediately succeeding Extended CV in the target is the same as that in the sample, and defined to be "1" when they are different. However, in case that the immediately succeeding phoneme in the target is the same as that in the sample, rightward target distortion is defined to be "0" even if the both following Extended CVs do not match up with each other. Furthermore, when the immediately following phoneme in the target is a silence, an unvoiced plosive, or when an unvoiced affricative, or the target Extended CV itself is a geminated sound (Japanese SOKUON), and the immediately following phoneme in the sample is a silence, an unvoiced plosive, or an unvoiced affricative, rightward target distortion is defined to be "0", considering that both following phonemes are conforming to each other.

"Contextual distortion" is defined as the sum of "leftward contextual distortion" and "rightward contextual distortion".

"Leftward contextual distortion" is defined to be "0" when all Extended CVs from the objective Extended CV to the first are matching up between the target and the sample. If the mth Extended CVs from the objective in the target and the sample do not match up with each other, leftward contextual distortion is to be "1/m".

"Rightward contextual distortion" is defined to be "0" when all. Extended CVs from the objective Extended CV to the end are matching up between the target and the sample. If the mth Extended CVs from the objective in the target and the sample do not match up with each other, rightward contextual distortion is to be "1/m".

"Continuity distortion" is defined to be "0" when the Extended CV candidates from the speech corpus corresponding to the two Extended CVs that are contiguously linked in the target (such as "rai" and "u") are also contiguous in the same sound file. If they are not contiguous, continuity distortion is defined to be "1". In other words, when Extended CVs in a candidate sequence are stored also contiguously in the speech corpus, the continuity distortion is considered null.

Figure 12C:
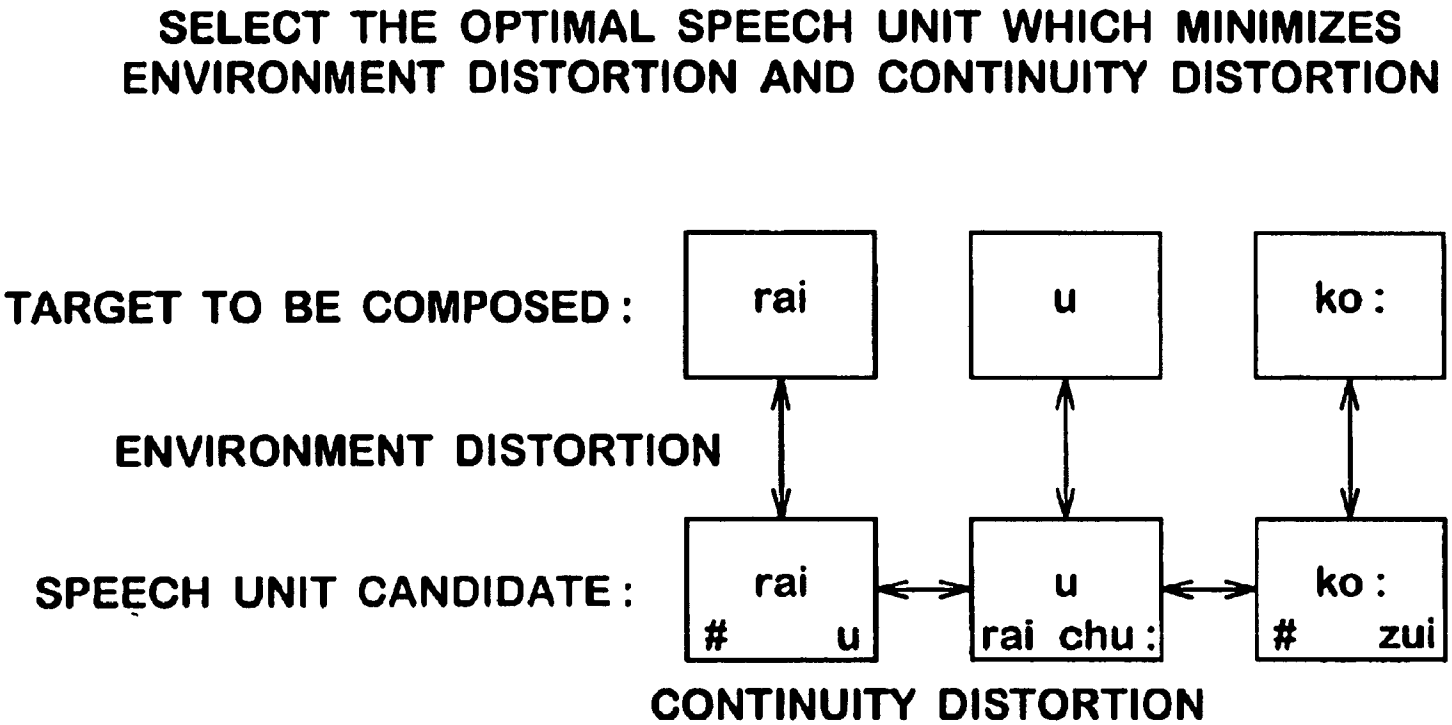
FIG. 12C is a view illustrating a relationship between environment distortion and continuity distortion.
Figure 13:
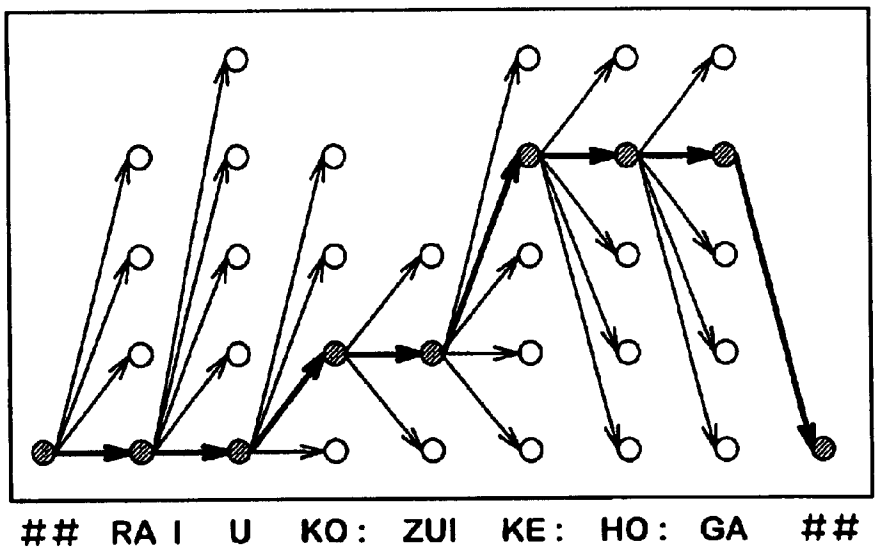
FIG. 13 is a diagram showing the procedure of determining the optimal Extended CVs.

Returning to FIG. 11, when all the Extended CVs have been extracted in step S16, in step S18 the CPU 18 selects the optimal Extended CV from among the Extended CV candidates in such a way as to minimize the sum of "environment distortion" and "continuity distortion". FIG. 12C shows the measures for selection in schematic form. Accordingly, the optimal Extended CVs are selected from among the Extended CV candidates as shown in FIG. 13. In this representative embodiment, a dynamic programming method is used to determine the optimal Extended CVs.

Next, the CPU 18 concatenates the determined optimal Extended CVs and generates a speech waveform data (step S19 in FIG. 11). "Continuity distortion" should be taken into consideration again in the concatenation procedure.

When the Extended CV candidates are contiguously linked to one another with the continuity distortion of "0", their corresponding sample speech waveform data is extracted in a single unit from the speech sound file, referring to the entries. In addition, for two contiguous Extended CV candidates with the continuity distortion of "1", each sample speech waveform for the first and the second Extended CV is extracted one by one. Then, two sample waveforms are concatenated. In this case, in order to reduce any discontinuities across the boundaries of the waveforms, the desirable concatenation points (such as the points where each amplitude is close to zero and each amplitude changes toward the same direction) must be searched at around the end of the first sample waveform and the beginning of the second. Then, sample speech waveforms are clipped out at these points and concatenated.

Figure 14:
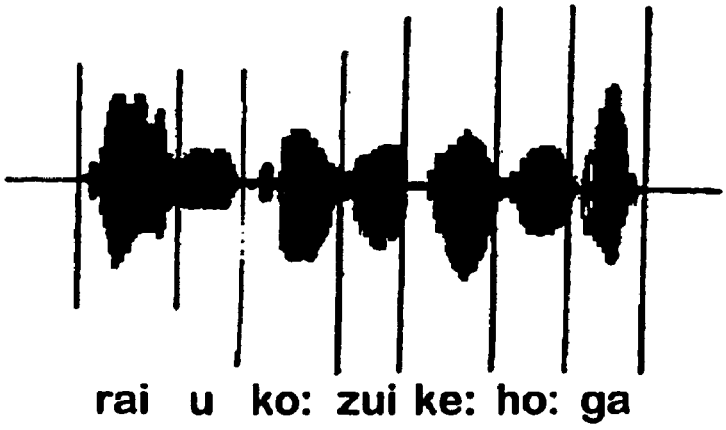
FIG. 14 shows a composite speech waveform data.

Thus, the speech waveform data corresponding to "ra i u ko: zu i ke: ho: ga" is obtained as shown in FIG. 14.

The CPU 18 provides this data to the sound card 28. The sound card 28 converts the provided speech waveform data into analog sound signals and produces output through the speaker 29.

In this embodiment, the speech corpus 42 is searched for Extended CVs to be extracted. However, Extended CVs may be extracted according to the rules of Extended CV as in the case of constructing the speech corpus.

(5) Other Embodiment

In the embodiments described above, Extended CV is defined on condition that the number of vowels in vowel catenation is limited to at most two. However, vowel catenation in Extended CV may contain three or more vowels. For instance, the phoneme sequence such as "kyai:N" or "gyuo:N" which contains a long sound and a diphthong, may be treated as an Extended CV.

Even though the number of vowels in vowel catenation is limited to at most two, the contiguous Extended CV candidates with the "continuity distortion" of "0", their corresponding sample speech waveforms that are extracted in a single unit, which might therefore contain three or more vowels.

Furthermore, in the embodiment described above, the speech corpus 42 is constructed by way of storing speech waveform data. However, sound characteristic parameters such as PARCOR coefficient may be stored as a speech corpus. This might affect the quality of synthesized sound but helps in minimizing the size of a speech corpus.

While, in the above embodiment, a CPU is used to provide the respective functions shown in FIG. 1, a part or all of the functions may be given by using hardware logic.

Figure 15:
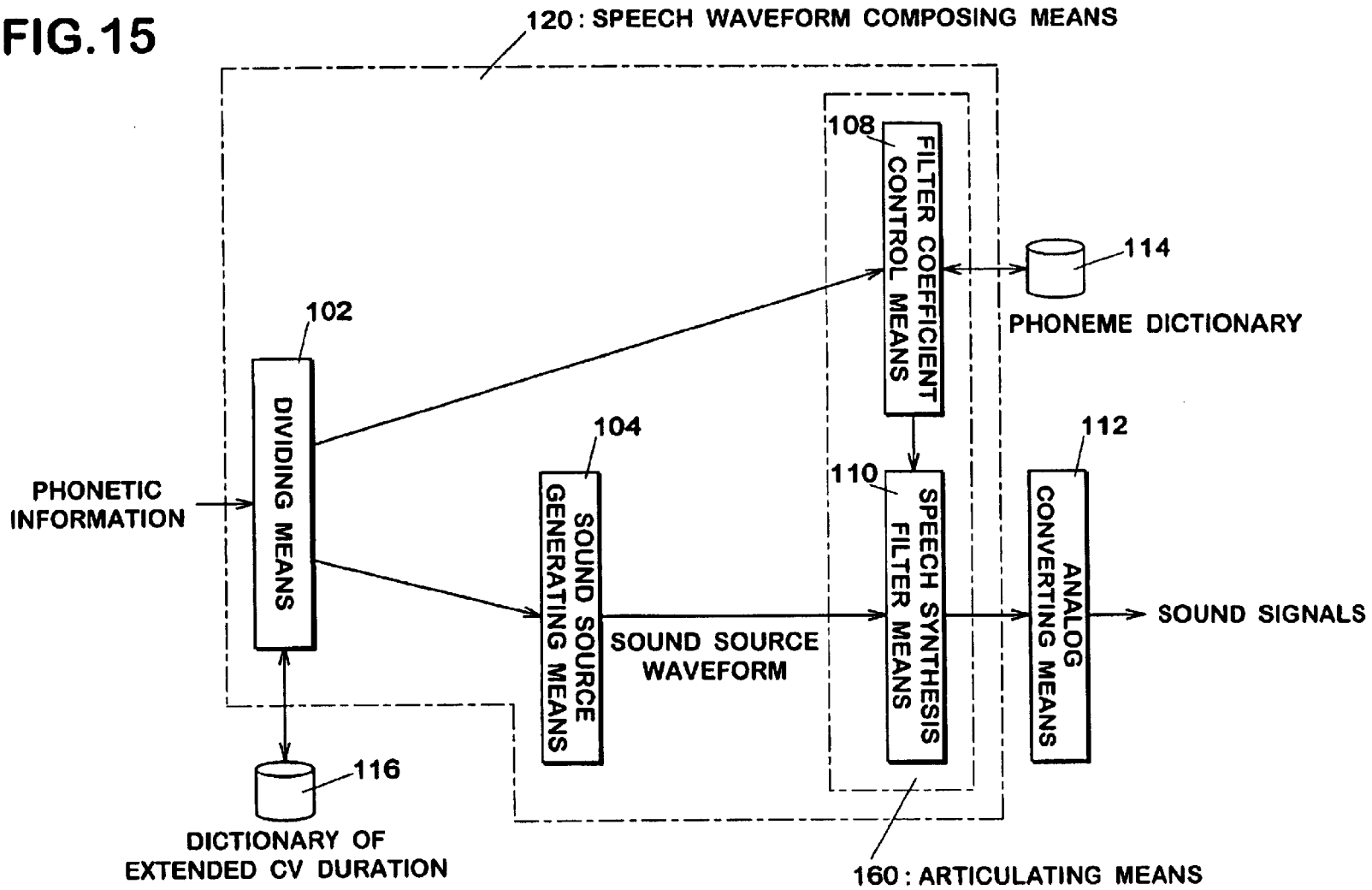
FIG. 15 shows an overall configuration of the speech synthesis device according to the second representative embodiment of the present invention.

2. THE SECOND REPRESENTATIVE EMBODIMENT OF THE PRESENT INVENTION (1) Overall Structure FIG. 15 shows an overall structure of the speech synthesis device according to a second representative embodiment of the present invention. This device, which performs a speech synthesis by rule, comprises dividing means 102, sound source generating means 104, articulation means 106, and analog converting means 112. The articulation means 106, comprises filter coefficient control means 108 and speech synthesis filter means 110. A dictionary of duration of Extended CV 116 stores the duration of each Extended CV. In a phoneme dictionary 114 stores the contour of vocal tract transmission characteristic for each Extended CV.

The phonetic information of speech sound to be synthesized is provided to the dividing means 102. The dividing means 102 divides the phonetic information into Extended CVs and provides them to the filter coefficient control means 180 and the sound source generating means 104. Further, the dividing means 102, making a reference to the dictionary of Extended CV duration 116, calculates the duration of each divided Extended CV and provides the same to the sound source generating means 104. According to the information from the dividing means 102, the sound source generating means 104 generates the sound source waveform corresponding to the said Extended CVs.

Meanwhile, the filter coefficient control means 108, making a reference to the phoneme dictionary 114, and according to the phonetic information of Extended CVs, obtains the contour of vocal tract transmission characteristic of the said Extended CVs. Then, in associated with the contour of vocal tract transmission characteristic, the filter coefficient control means 108 provides the filter coefficient, which implements these vocal tract transmission characteristic, into the speech synthesis filter means 110. The speech synthesis filter means 110, in turn, performs the articulation by filtering the generated sound source waveforms with the vocal tract transmission characteristic, in synchronization with each Extended CV, and produces output as composite speech waveforms. Then, the analog converting means 112 converts the composite speech waveforms into analog signals.

(2) Hardware Configuration

Figure 16:
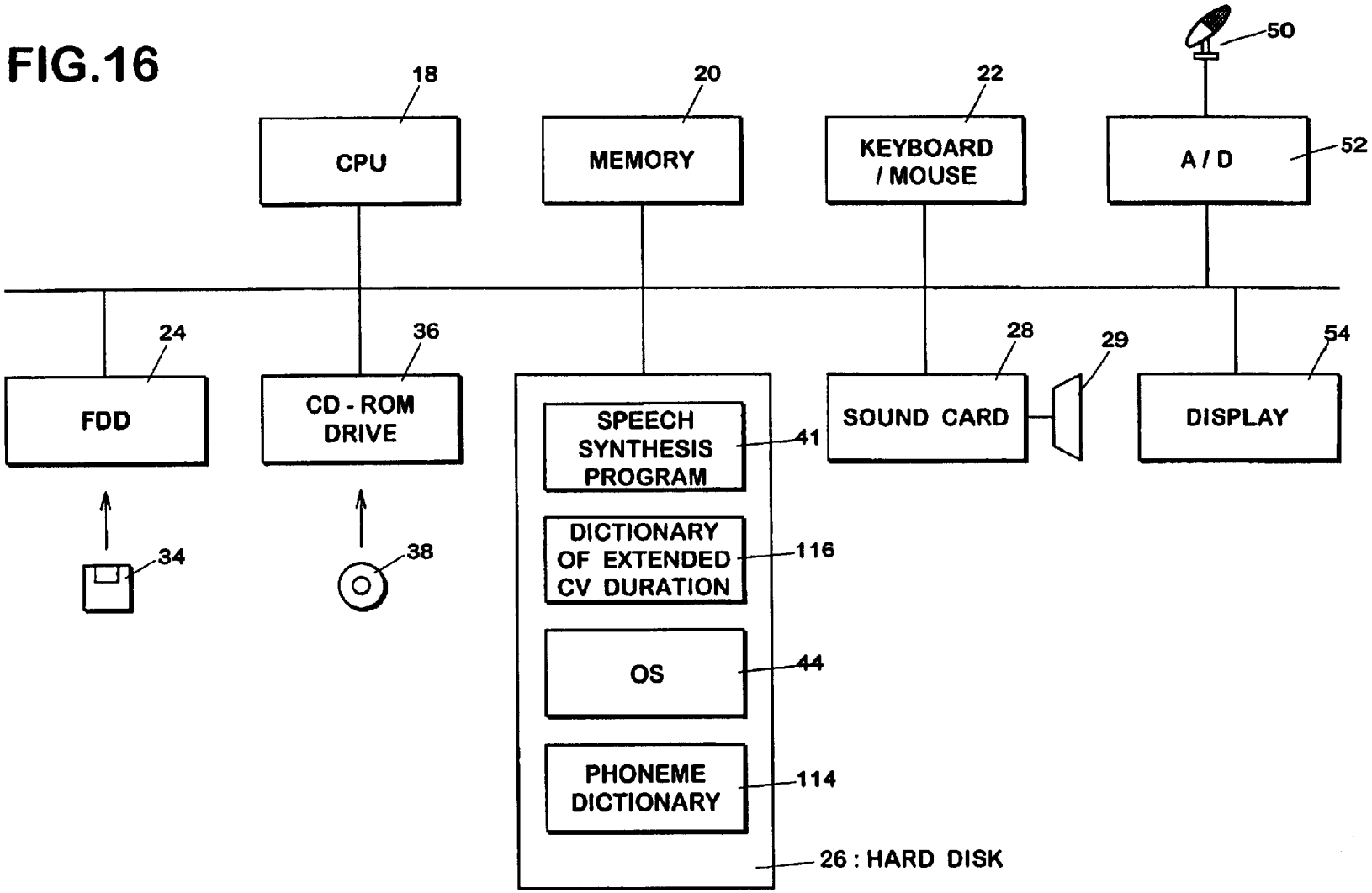
FIG. 16 is a view showing a hardware configuration of the speech synthesis device according the second representative embodiment of the present invention.

FIG. 16 shows an embodiment of a hardware configuration using a CPU for the device of FIG. 15. Connected to a CPU 18 are a memory 20, a keyboard/mouse 22, a floppy disk drive (FDD) 24, a CD-ROM drive 36, a hard disk 26, a sound card 28, an A/D converter 62 and a display 54. An operating system (OS) 44 such as WINDOWS 98™ by Microsoft™ and a speech synthesis program 41 are stored in the hard disk 26. These programs are installed from the CD-ROM 38 using the CD-ROM drive 36. A dictionary of duration of Extended CV 116 and the phoneme dictionary 114 are also stored on the hard disk 26.

(3) Speech Synthesis Processing

Figure 17:
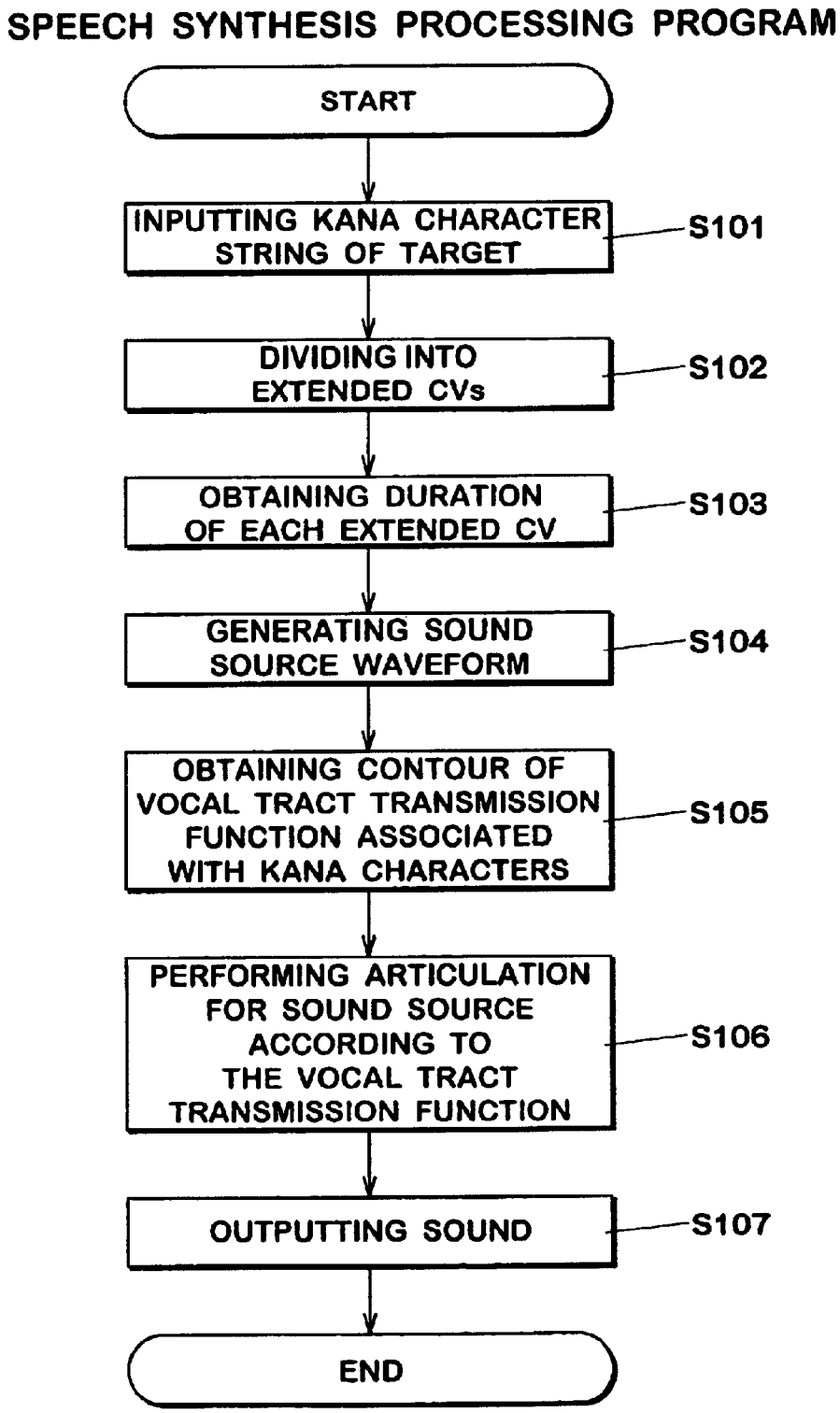
FIG. 17 is a flow chart showing the speech synthesis processing program according to the second representative embodiment of the present invention.

FIG. 17 is a flow chart showing the speech synthesis program. The operator inputs a "kana character string" corresponding to the target of synthesized speech (speech sound to be synthesized) using the keyboard 22 (step S101 in FIG. 17). Alternatively, the kana character string may be loaded in from the floppy disk 34 through the FDD 24 or may be transferred from other computers through networks. Optionally, other phonetic information such as kanji and kana text may be converted into a "kana character string" with using a dictionary that is prestored in the hard disk 26. Further, prosodic information such as accents or pauses may be added.

Next, the CPU 18 divides this kana character string into Extended CVs according to rules based on the definition of Extended CV or a table listing Extended CVs (step S102 in FIG. 17). Then, the CPU 18 obtains the duration of each Extended CV by referring to the dictionary of Extended CV duration 116 shown in FIG. 18. If the contents of this dictionary is sorted in order of decreasing number of characters, as in the case of unit index in FIG. 9, the duration of Extended CV can be obtained simultaneously by dividing procedure in a like manner of step S11 to S17 in FIG. 10.

Furthermore, the CPU 18, in associated with the character string of each Extended CV and the accent information obtained through morphological analysis, generates a sound source waveform corresponding to each Extended. CV (step S104 in FIG. 17).

Next, the CPU 18 obtains the contour of vocal tract transmission function corresponding to each Extended CV, referring a reference to the phoneme dictionary 114 as shown in FIG. 19, in which the contour of vocal tract transmission function for each Extended CV are stored (step S105 in FIG. 17). Moreover, the CPU 18 performs the articulation for the sound source waveform of each Extended CV in order to implement the previously mentioned contour of vocal tract transmission function (step S106 in FIG. 17).

The composed speech waveform as above is provided to the sound card 28. Then, the sound card 28 produces output as a speech sound (step S107 in FIG. 17).

Since the speech synthesis in this representative embodiment is performed using Extended CV as a speech unit, a high-quality natural-sounding synthesized speech can be provided, eliminating the discontinuity across the boundaries of the waveforms.

(4) Other Embodiments of Speech Synthesis Processing

The modifications mentioned in the first representative embodiment may be also applied to this second representative embodiment.

3. OTHER REPRESENTATIVE EMBODIMENTS

The above embodiments describe the speech synthesis using Extended CV as a speech unit. However, Extended CV may be applicable to speech processing in general. For example, if Extended CV is employed as a speech unit in speech analysis, the accuracy of analysis can be improved.

4. FUNCTION AND ADVANTAGES OF THE PRESENT INVENTION

In the present invention, in order to synthesize more humanly sounding speech sound with natural rhythm and spectrum dynamism and to conduct a more accurate speech analysis, the concept of Extended CV (Consonant-Vowel) as a speech unit capable of keeping natural rhythm has been proposed mainly from the following two view points.

1. a speech unit for extracting a piece of stable speech waveform 2. a minimal unit of sound rhythm which can not be split any more.

Employment of the Extended CV as a speech unit improves the naturalness at the concatenation points of pieces of waveform such as in "vowel-vowel catenation", "semi vowel-vowel catenation" or "a special mora", which has had so far continuity problems.

The following paragraphs describe more about the viewpoint 1 and 2. The following description relates to speech synthesis. However, this discussion is also applicable to speech analysis.

View point 1-A speech unit for extracting a niece of stable speech waveform.

Tb synthesize a natural-sounding speech, it is necessary to keep the dynamic movements of speech sound, which appears at a transitional segment of continuous data of spectra and fundamental frequencies of speech sound, within a speech unit. Therefore, a piece of speech waveforms shall be extracted from the segment where the said continuous data is stable. In addition, the optimal speech unit for extracting a stable speech waveform is a unit holding the transition of spectra and accents. The "Extended CV" of the present invention will satisfy these conditions.

View point 2-A minimal unit of sound rhythm that can not be split any more.

To synthesize a natural-sounding speech, rhythm is considered the first item in the structure of speech utterance because rhythm is most significant among prosodic information of speech sound.

The rhythm of talk is considered to arise not only from the simple summation of duration of consonants and vowels as speech utterance components but also from the repeats of language structure in a certain clause unit, which sound comfortable to the talker. For example, in the modern spoken Japanese, duration of each kind of vowels is distinctive. A long vowel, a diphthong and a short vowel give a respective different meaning. Therefore, disregarding the difference between "/a:/, long vowel" and "/a//a/, sequence of short vowels" will affect the quality of synthesized speech sound.

Consequently, to maintain the rhythm of utterances, "Extended CV" is supposed to be a desirable "minimal unit of rhythm" such as a "molecule" in chemistry. On the other hand, splitting utterances into pieces smaller than "Extended CV", will destroy the natural rhythm of speech sound.

From these points of view, the present invention employs a new concept of "Extended CV" into speech processing.

The speech synthesis device of the present invention is characterized in that the device comprises: speech database storing means for storing speech database created by dividing the sample speech waveform data obtained from recording human speech utterances into speech units, and as well as, associating the sample speech waveform data in each speech unit with their corresponding phonetic information;

speech waveform composing means for dividing phonetic information into speech units upon receiving phonetic information of speech sound to be synthesized, for obtaining sample speech waveform data from the speech database corresponding to the each phonetic information in a speech unit, and for generating speech waveform data to be composed by means of concatenating the sample speech waveform data in the speech unit;

and analog converting means for converting the speech waveform data received from the speech waveform composing means into analog signals;

wherein the speech database storing means divides the sample speech waveform data into the speech units of Extended CV, which is a contiguous sequence of phonemes without clear distinction containing a vowel or some vowels, and the speech waveform composing means divides the phonetic information into speech units of Extended CV.

In other words, in the case that there is a contiguous sequence of phonemes without clear distinction, these phonemes are treated as one unit, that is Extended CV, based on which a speech unit is to be extracted from the sample speech waveform data. Therefore, sample waveform data need not be concatenated for a sequence of phonemes that is hard to be divided due to its characteristic. Then, natural-sounding speech can be synthesized.

The speech synthesis device of the present invention includes: dividing means for dividing the phonetic information into Extended CVs upon receiving the phonetic information of speech sound to be synthesized;

speech waveform composing means for generating speech waveform data in a unit of Extended CV divided with the dividing means, and obtaining speech waveform data to be composed by means of concatenating the speech waveform data in each Extended CV; and analog converting means for converting the speech waveform data provided from the speech waveform composing means into analog signals of speech sound. Here, Extended CV refers to a contiguous sequence of phonemes without clear distinction containing at least one vowel.

In other words, in case in which there is a contiguous sequence of phonemes without clear distinction, these phonemes is treated as one unit, that is Extended CV, based on which speech synthesis are carried out. Therefore, composite waveform data need not be concatenated for a sequence of phonemes that is hard to divide due to its characteristic. Thus, natural-sounding speech can be synthesized.

The speech synthesis device of the present invention is characterized in that it is defined that Extended CV is a sequence of phonemes containing, as a vowel element, either one of a vowel, a combination of a vowel and the latter part of a long vowel, or a combination of a vowel and the second element of a diphthong, and that the longer sequence shall be first selected as Extended CV.

Accordingly, by treating a combination of a vowel and the latter part of a long vowel, and a vowel and the second element of a diphthong as one unit of phonemes, natural-sounding speech can be synthesized.

The speech synthesis device of the present invention is further characterized in that it is defined that Extended CV may contain a consonant "C" (excluding a geminated sound (Japanese SOKUON), a semi vowel and a syllabic nasal), a semi vowel "y", a vowel "V" (excluding the latter part of a long vowel and the second element of a diphthong), the latter part of a long vowel "R", the second element of a diphthong "J", a geminated sound "Q" and a syllabic nasal "N", and that the phoneme sequence with heavier syllable weight is selected first as Extended CV assuming the syllable weight of "C" and y to be "0", and those of "V", "R", "J", "Q" and "N" to be "1".

The speech synthesis device of the present invention is further characterized in that Extended CV includes at least a heavy syllable with the syllable weight of "2" such as (C)(y)VR, (C)(y)VJ, (C)(y)VN and (C)(y)VQ and a light syllable with the syllable weight of '1' such as (C)(y)V and that the heavy syllable is given a higher priority than the light syllable for being selected as Extended CV.

The speech synthesis device of the present invention is further m characterized in that Extended CV further includes a superheavy syllable with the syllable weight of "3"such as (C)(y)VRN, (C)(y)VRQ, (C)(y)VJN, (C)(y)VJQ and (C)(y) VNQ, and that the heavy syllable is given a higher priority than the light syllable and the superheavy syllable takes precedence over the heavy syllable for being selected as Extended CV.

The speech synthesis device of the present invention is further characterized in that the speech database is constructed in such a way that Extended CV can be searched for in order of decreasing length of a kana character string representing the reading of Extended CV.

Therefore, the Extended CV with the longest character string is automatically selected first by way of searching the speech database in sequence.

While the embodiments of the present invention, as disclosed herein, constitute preferred forms, it is to be understood that each term and embodiment was used as illustrative and not restrictive, and can be changed within the scope of the claims without departing from the scope and spirit of the invention.

What is claimed is:

1. A speech synthesis device comprising:

speech database storing means for storing a speech database created by way of dividing the sample speech waveform data obtained from recording human speech utterances into speech units, and associating the sample waveform data in each speech unit with their corresponding phonetic information;

speech waveform composing means for dividing phonetic information into speech units upon receiving the phonetic information of speech sound to be synthesized, for obtaining sample speech waveform data from the speech database corresponding to the phonetic information in a speech unit, and for generating speech waveform data to be composed by means of concatenating the sample speech waveform data in the speech unit; and analog converting means for converting the speech waveform data received from the speech waveform composing means into analog signals;

wherein the speech database storing means divides the sample speech waveform data into speech units of Extended CV, which is a contiguous sequence of phonemes without clear distinction containing a vowel or some vowels;

wherein the speech waveform composing means divides the phonetic information into speech units of Extended CV;

wherein the Extended CV contains at least one of a consonant C excluding a geminated sound (Japanese SOKUON), a semi vowel, and a syllabic nasal, a semi vowel y, a vowel V excluding a latter part of a long vowel and a second element of a diphthong, a latter part of a long vowel R, the second element of a diphthong J, a geminated sound Q, and a syllabic nasal N, and wherein the phoneme sequence with heavier syllable weight is selected first as the Extended CV, assuming the syllable weight of C and y to be "0", and a syllable weight of V, R, J, Q and N to be "1".

2. A speech synthesis device comprising:

speech database storing means for storing a speech database created by way of dividing the sample speech waveform data obtained from recording human speech utterances into speech units, and associating the sample waveform data in each speech unit with their corresponding phonetic information;

speech waveform composing means for dividing phonetic information into speech units upon receiving the phonetic information of speech sound to be synthesized, for obtaining sample speech waveform data from the speech database corresponding to the phonetic information in a speech unit, and for generating speech waveform data to be composed by means of concatenating the sample speech waveform data in the speech unit; and analog converting means for converting the speech waveform data received from the speech waveform composing means into analog signals;

wherein the speech database storing means divides the sample speech waveform data into speech units of Extended CV, which is a contiguous sequence of phonemes without clear distinction containing a vowel or some vowels;

wherein the Extended CV includes at least a heavy syllable with a syllable weight of "2" selected from a group consisting of (C)(y) VR, (C)(y) VJ, (C)(y) VN and (C)(y) VQ and a light syllable with the syllable weight of "1" as defined by (C)(y) V, wherein the heavy syllable is given a higher priority than the light syllable for being selected as Extended CV, wherein (C) denotes that C or some Cs are attached to V, wherein (y) denotes whether y or ys are attached to V, and wherein C is a consonant excluding a geminated sound (Japanese SOKUON), a semi vowel, and a syllabic nasal, y is a semi vowel, V is a vowel excluding a latter part of a long vowel and a second element of a diphthong, R is a latter part of a long vowel, J is the second element of a diphthong, Q is a geminated sound, and N is a syllabic nasal.

3. The speech synthesis device of claim 2, wherein the Extended CV further includes a superheavy syllable with a syllable weight of "3" such as (C)(y) VRN, (C)(y) VRQ, (C)(y) VJN, (C)(y) VJQ and (C)(y) VNQ, and wherein the heavy syllable is given a higher priority than the light syllable and the superheavy syllable takes precedence over the heavy syllable for being selected as Extended CV.

4. A computer-readable storing medium for storing a program for executing speech synthesis by means of a computer using a speech database constructed with sample speech waveform data associated with its corresponding phonetic information, the program comprising the steps of:

dividing phonetic information into Extended CVs upon receiving the phonetic information of speech sound to be synthesized;

obtaining sample speech waveform data corresponding to the divided phonetic information in Extended CV from the speech database; and generating speech waveform data to be composed by means of concatenating the sample speech waveform data in Extended CV;

wherein the Extended CV refers to a contiguous sequence of phonemes without clear distinction containing at least one vowel, wherein the Extended CV contains at least one of a consonant C excluding a geminated sound (Japanese SOKUON), a semi vowel, and a syllabic nasal, a semi vowel y, a vowel V excluding a latter part of a long vowel and a second element of a diphthong, a latter part of a long vowel R, the second element of a diphthong J, a geminated sound Q, and a syllabic nasal N, and wherein the phoneme sequence with heavier syllable weight is selected first as the Extended CV, assuming the syllable weight of C and y to be "0", and a syllable weight of V, R, J, Q and N to be "1".

5. A computer-readable storing medium for storing a program for executing speech synthesis by means of a computer using a speech database constructed with sample speech waveform data associated with its corresponding phonetic information, the program comprising the steps of:

dividing phonetic information into Extended CVs upon receiving the phonetic information of speech sound to be synthesized;

obtaining sample speech waveform data corresponding to the divided phonetic information in Extended CV from the speech database; and generating speech waveform data to be composed by means of concatenating the sample speech waveform data in Extended CV;

wherein the Extended CV refers to a contiguous sequence of phonemes without clear distinction containing at least one vowel, wherein the Extended CV includes at least a heavy syllable with a syllable weight of "2" selected from a group consisting of (C)(y) VR, (C)(y) VJ, (Cy) VN and (C)(y) VQ and a light syllable with the syllable weight of "1" as defined by (C)(y) V, wherein the heavy syllable is given a higher priority than the light syllable for being selected as Extended CV, wherein (C) denotes that C or some Cs are attached to V, wherein (y) denotes whether y or ys are attached to V, and wherein C is a consonant excluding a geminated sound (Japanese SOKUON), a semi vowel, and a syllabic nasal, y is a semi vowel, V is a vowel excluding a latter part of a long vowel and a second element of a diphthong R is a latter part of a long vowel, J is the second element of a diphthong, Q is a geminated sound, and N is a syllabic nasal.

6. The computer-readable storage medium of claim 5, wherein the Extended CV further includes a superheavy syllable with a syllable weight of "3" such as (C)(y) VRN, (C)(y) VRQ, (C)(y) VJN, (C)(y) VJQ and (C)(y) VNQ, and wherein the heavy syllable is given a higher priority than the light syllable and the superheavy syllable takes precedence over the heavy syllable for being selected as Extended CV.

7. A speech synthesis device comprising:

dividing means for dividing the phonetic information into Extended CVs upon receiving the phonetic information of speech sound to be synthesized;

speech waveform composing means for generating speech waveform data in a unit of Extended CV divided with the dividing means, and for obtaining speech waveform data to be composed by means of concatenating the speech waveform data in a unit of each Extended CV; and analog converting means for converting the speech waveform data provided from the speech waveform composing means into analog signals of speech sound;

wherein the Extended CV refers to a contiguous sequence of phonemes without clear distinction containing at least one vowel, wherein the Extended CV contains at least one of a consonant C excluding a geminated sound (Japanese SOKUON), a semi vowel, and a syllabic nasal, a semi vowel y, a vowel V excluding a latter part of a long vowel and a second element of a diphthong, a latter part of a long vowel R, the second element of a diphthong J, a geminated sound Q, and a syllabic nasal N, and wherein the phoneme sequence with heavier syllable weight is selected first as the Extended CV, assuming the syllable weight of C and y to be "0", and a syllable weight of V, R, J, Q and N to be "1".

8. A speech synthesis device comprising:

dividing means for dividing the phonetic information into Extended CVs upon receiving the phonetic information of speech sound to be synthesized;

speech waveform composing means for generating speech waveform data in a unit of Extended CV divided with the dividing means, and for obtaining speech waveform data to be composed by means of concatenating the speech waveform data in a unit of each Extended CV; and analog converting means for converting the speech waveform data provided from the speech waveform composing means into analog signals of speech sound;

wherein the Extended CV refers to a contiguous sequence of phonemes without clear distinction containing at least one vowel, wherein the Extended CV includes at least a heavy syllable with a syllable weight of "2" selected from a group consisting of (C)(y) VR, (C)(y) VJ, (C)(y) VN and (C)(y) VQ and a light syllable with the syllable weight of "1" as defined by (C)(y) V, wherein the heavy syllable is given a higher priority than the light syllable for being selected as Extended CV, wherein (C) denotes that C or some Cs are attached to V, wherein (y) denotes whether y or ys are attached to V, and wherein C is a consonant excluding a germinated sound (Japanese SOKUON), a semi vowel, and a syllabic nasal, y is a semi vowel, V is a vowel excluding a latter part of a long vowel and a second element of a diphthong, R is a latter part of a long vowel, J is the second element of a diphthongs, Q is a geminated sound, and N is a syllabic nasal.

9. The speech synthesis device of claim 8, wherein the Extended CV further includes a superheavy syllable with a syllable weight of "3" such as (C)(y) VRN, (C)(y) VRQ, (C)(y) VJN, (C)(y) VJQ and (C)(y) VNQ, and wherein the heavy syllable is given a higher priority than the light syllable and the superheavy syllable takes precedence over the heavy syllable for being selected as Extended CV.

10. A computer-readable storing medium for storing a program for executing speech synthesis using a computer, the program comprising the steps of:

dividing phonetic information into Extended CVs upon receiving the phonetic information of speech sound to be synthesized;

generating speech waveform data in a unit of Extended CV; and obtaining speech waveform data to be composed by means of concatenating the speech waveform data in a unit of each Extended CV;

wherein the Extended CV refers to a contiguous sequence of phonemes without clear distinction containing at least one vowel, wherein the Extended CV contains at least one of a consonant C excluding a geminated sound (Japanese SOKUON), a semi vowel, and a syllabic nasal, a semi vowel y, a vowel V excluding a latter part of a long vowel and a second element of a diphthong, a latter part of a long vowel R, the second element of a diphthong J, a geminated sound Q, and a syllabic nasal N, and wherein the phoneme sequence with heavier syllable weight is selected first as the Extended CV, assuming the syllable weight of C and y to be "0", and a syllable weight of V, R, J, Q and N to be "1".

11. A computer-readable storing medium for storing a program for executing speech synthesis using a computer, the program comprising the steps of:

dividing phonetic information into Extended CVs upon receiving the phonetic information of speech sound to be synthesized;

generating speech waveform data in a unit of Extended CV; and obtaining speech waveform data to be composed by means of concatenating the speech waveform data in a unit of each Extended CV;

wherein the Extended CV refers to a contiguous sequence of phonemes without clear distinction containing at least one vowel, wherein the Extended CV includes at least a heavy syllable with a syllable weight of "2" selected from a group consisting of (C)(y) VR, (C)(y) VJ, (C)(y) VN and (C) (y) VQ and a light syllable with the syllable weight of "1" as defined by (C)(y) V, wherein the heavy syllable is given a higher priority than the light syllable for being selected as Extended CV, wherein (C) denotes that C or some Cs are attached to V, wherein (y) denotes whether y or ys are attached to V, and wherein C is a consonant excluding a geminated sound (Japanese SOKUON), a semi vowel, and a syllabic nasal, y is a semi vowel, V is a vowel excluding a latter part of a long vowel and a second element of a diphthong, R is a latter part of a lone vowel, J is the second element of a diphthong, Q is a geminated sound, and N is a syllabic nasal.

12. The computer-readable storing medium of claim 11, wherein the Extended CV further includes a superheavy syllable with a syllable weight of "3" such as (C)(y) VRN, (C)(y) VRQ, (C)(y) VJN, (C)(y) VJQ and (C)(y) VNQ, and wherein the heavy syllable is given a higher priority than the light syllable and the superheavy syllable takes precedence over the heavy syllable for being selected as Extended CV.

13. A computer-readable storing medium for storing a program for executing dividing process using a computer, the program comprising the step of:

dividing phonetic information into Extended CVs defined as follows, upon receiving the phonetic information;

wherein the Extended CV refers to a contiguous sequence of phonemes without clear distinction containing at least one vowel, wherein the Extended CV contains at least one of a consonant C excluding a geminated sound (Japanese SOKUON), a semi vowel, and a syllabic nasal, a semi vowel y, a vowel V excluding a latter part of a long vowel and a second element of a diphthong, a latter part of a long vowel R, the second element of a diphthong J, a geminated sound Q, and a syllabic nasal N, and wherein the phoneme sequence with heavier syllable weight is selected first as the Extended CV, assuming the syllable weight of C and y to be "0", and a syllable weight of V, R, J, Q and N to be "1".

14. A computer-readable storing medium for storing a program for executing dividing process using a computer, the program comprising the step of:

dividing phonetic information into Extended CVs defined as follows, upon receiving the phonetic information;

wherein the Extended CV refers to a contiguous sequence of phonemes without clear distinction containing at least one vowel, wherein the Extended CV includes at least a heavy syllable with a syllable weight of "2" selected from a group consisting of (C)(y) VR, (C)(y) VJ, (C) (y) VN and (C)(y) VQ and a light syllable with the syllable weight of "1" as defined by (C)(y) V, wherein the heavy syllable is given a higher priority than the light syllable for being selected as Extended CV, wherein (C) denotes that C or some Cs are attached to V, wherein (y) denotes whether y or ys are attached to V, and wherein C is a consonant excluding a geminated sound (Japanese SOKUON), a semi vowel, and a syllabic nasal, y is a semi vowel, V is a vowel excluding a latter part of a long vowel and a second element of a diphthong, R is a latter part of a long vowel, J is the second element of a diphthong, Q is a germinated sound, and N is a syllabic nasal.

15. A computer-readable storing medium for storing a speech database, the database comprising:

a waveform data area that stores sample speech waveform data divided into Extended CV; and a phonetic information area that stores the phonetic information associated with sample speech waveform data in a unit of each Extended CV;

wherein the Extended CV refers to a contiguous sequence of phonemes without clear distinction containing at least one vowel, wherein the Extended CV contains at least one of a consonant C excluding a geminated sound (Japanese SOKUON), a semi vowel, and a syllabic nasal, a semi vowel y, a vowel V excluding a latter part of a long vowel and a second element of a diphthong, a latter part of a long vowel R, the second element of a diphthong J, a germinated sound Q, and a syllabic nasal N, and wherein the phoneme sequence with heavier syllable weight is selected first as the Extended CV assuming the syllable weight of C and y to be "0" and a syllable weight of V, R, J, Q and N to be "1".

16. A computer-readable storing medium for storing a speech database, the database comprising:

a waveform data area that stores sample speech waveform data divided into Extended CV; and a phonetic information area that stores the phonetic information associated with sample speech waveform data in a unit of each Extended CV;

wherein the Extended CV refers to a contiguous sequence of phonemes without clear distinction containing at least one vowel, wherein the Extended CV includes at least a heavy syllable with a syllable weight of "2" selected from a group consisting of (C)(y) VR, (C)(y) VJ, (C) (y) VN and (C)(y) VQ and a light syllable with the syllable weight of "1" as defined by (C)(y) V, wherein the heavy syllable is given a higher priority than the light syllable for being selected as Extended CV, wherein (C) denotes that C or some Cs are attached to V, wherein (y) denotes whether y or ys are attached to V, and wherein C is a consonant excluding a geminated sound (Japanese SOKUON), a semi vowel, and a syllabic nasal, y is a semi vowel, V is a vowel excluding a latter part of a long vowel and a second element of a diphthong, R is a latter part of a long vowel, J is the second element of a diphthong, Q is a germinated sound, and N is a syllabic nasal.

17. A computer-readable storing medium for storing phonetic information data to be used for speech, processing, wherein the phonetic, information data is characterized by being handled in a unit of Extended CV provided with division information per Extended CV, wherein the Extended CV refers to a contiguous sequence of phonemes without clear distinction containing at least one vowel, wherein the Extended CV contains at least one of a consonant C excluding a geminated sound (Japanese SOKUON), a semi vowel, and a syllabic nasal, a semi vowel y, a vowel V excluding a latter part of a long vowel and a second element of a diphthong, a latter part of a long vowel R, the second element of a diphthong J, a geminated sound Q, and a syllabic nasal N, and wherein the phoneme sequence with heavier syllable weight is selected first as the Extended CV assuming the syllable weight of C and y to be "0", and a syllable weight of V, R, J, Q and N to be "1".

18. A computer-readable storing medium for storing phonetic information data to be used for speech processing, wherein the phonetic information data is characterized by being handled in a unit of Extended CV provided with division information per Extended CV, and wherein the Extended CV refers to a contiguous sequence of phonemes without clear distinction containing at least one vowel, wherein the Extended CV includes at least a heavy syllable with a syllable weight of "2" selected from a group consisting of (C)(y) VR, (C)(y) VJ, (C)(y) VN and (C)(y) VQ and a light syllable with the syllable weight of "1" as defined by (C)(y) V, wherein the heavy syllable is given a higher priority than the light syllable for being selected as Extended CV, wherein (C) denotes that C or some Cs are attached to V, wherein (y) denotes whether y or ys are attached to V, and wherein C is a consonant excluding a geminated sound (Japanese SOKUON), a semi vowel, and a syllabic nasal, y is a semi vowel, V is a vowel excluding a latter part of a long vowel and a second element of a diphthong, R is a latter part of a long vowel, J is the second element of a diphthong, Q is a geminated sound, and N is a syllabic nasal.

19. A computer-readable storing medium for storing a phoneme dictionary to be used for speech processing, wherein the phoneme dictionary contains a contour of vocal tract transmission function of each phoneme associated with phonetic information in a ma unit of Extended CV, wherein the Extended CV refers to a contiguous sequence of phonemes without clear distinction containing at least one vowel, wherein the Extended CV contains at least one of a consonant C excluding a geminated sound (Japanese SOKUON), a semi vowel, and a syllabic nasal, a semi vowel y, a vowel V excluding a latter part of a long vowel and a second element of a diphthong, a latter part of a long vowel R, the second element of a diphthong J, a geminated sound Q, and a syllabic nasal N, and wherein the phoneme sequence with heavier syllable weight is selected first as the Extended CV, assuming the syllable weight of C and y to be "0", and a syllable weight of V, R, J, Q and N to be "1".

20. A computer-readable storing medium for storing a phoneme dictionary to be used for speech processing, wherein the phoneme dictionary contains a contour of vocal tract transmission function of each phoneme associated with phonetic information in a unit of Extended CV;

wherein the Extended CV refers to a contiguous sequence of phonemes without clear distinction containing at least one vowel, wherein the Extended CV includes at least a heavy syllable with a syllable weight of "2" selected from a group consisting of (C)(y) VR, (C)(y) VJ, (C)(y) VN and (C)(y) VQ and a light syllable with the syllable weight of "1" as defined by (C)(y) V, wherein the heavy syllable is given a higher priority than the light syllable for being selected as Extended CM, and wherein (C) denotes that C or some Cs are attached to V, wherein (y) denotes whether y or ys are attached to V, and wherein C is a consonant excluding a geminated sound (Japanese SOKUON), a semi vowel, and a syllabic nasal, y is a semi vowel, V is a vowel excluding a latter part of a lone vowel and a second element of a diphthong, R is a latter part of a long vowel, J is the second element of a diphthong, Q is a geminated sound, and N is a syllabic nasal.

* * * * *